US005239798A

United States Patent [19]

Saito

[11] Patent Number: 5,239,798

[45] Date of Patent: Aug. 31, 1993

[54] EXTERNAL WALL PANEL AND MOUNTING STRUCTURE THEREOF

[75] Inventor: Makoto Saito, Tokyo, Japan

[73] Assignee: Kajima Corporation, Tokyo, Japan

[21] Appl. No.: 636,020

[22] Filed: Jan. 4, 1991

Related U.S. Application Data

[63] Continuation-in-part of Ser. No. 346,884, May 3, 1989, abandoned, and a continuation-in-part of Ser. No. 504,556, Apr. 3, 1990, abandoned.

[30] Foreign Application Priority Data

| | | | |
|---|---|---|---|
| Oct. 30, 1987 | [JP] | Japan | 62-275133 |
| May 9, 1988 | [JP] | Japan | 63-112257 |
| Sep. 29, 1988 | [JP] | Japan | 63-245436 |
| Oct. 24, 1988 | [JP] | Japan | 63-267738 |
| Jan. 27, 1989 | [JP] | Japan | 1-018189 |
| Feb. 27, 1989 | [JP] | Japan | 1-045582 |
| Apr. 4, 1989 | [JP] | Japan | 1-85381 |

[51] Int. Cl.[5] ..... E04B 1/38

[52] U.S. Cl. ..... 52/235; 52/508; 52/509; 52/511; 52/512

[58] Field of Search ..... 52/235, 508, 509, 510, 52/511, 302, 303, 204, 206, 512

[56] References Cited

U.S. PATENT DOCUMENTS

| | | | |
|---|---|---|---|
| 4,009,549 | 3/1977 | Hala | 52/235 |
| 4,074,486 | 2/1978 | Grearson | 52/235 |
| 4,307,551 | 12/1981 | Crandell | 52/235 |
| 4,423,576 | 1/1984 | Farina et al. | 52/235 |
| 4,506,482 | 3/1985 | Pracht et al. | 52/235 |
| 4,662,145 | 5/1987 | Tanikawa et al. | 52/235 |
| 4,685,263 | 8/1987 | Ting | 52/235 |
| 4,768,322 | 9/1988 | Kafarowski | 52/511 |
| 4,783,941 | 11/1988 | Loper et al. | 52/235 |
| 4,899,508 | 2/1990 | Biebuyck | 52/235 |
| 5,048,254 | 9/1991 | Merlau | 52/235 |

*Primary Examiner*—Michael Safavi
*Attorney, Agent, or Firm*—James H. Tilberry

[57] ABSTRACT

An exterior wall panel as the basic component of a curtain wall for a multi-storied building. The wall panel includes a steel frame and fastening means for securing the frame to steel girders of a building. Mounting means to secure the wall panel to the exterior side of the steel frame include fastening means which removably interconnect the wall panel and the steel frame. The wall panel may comprise a plurality of panel segments to which steel furring strips attach. An interior wall panel may be secured to the interior side of the steel frame.

10 Claims, 29 Drawing Sheets

FIG. 57
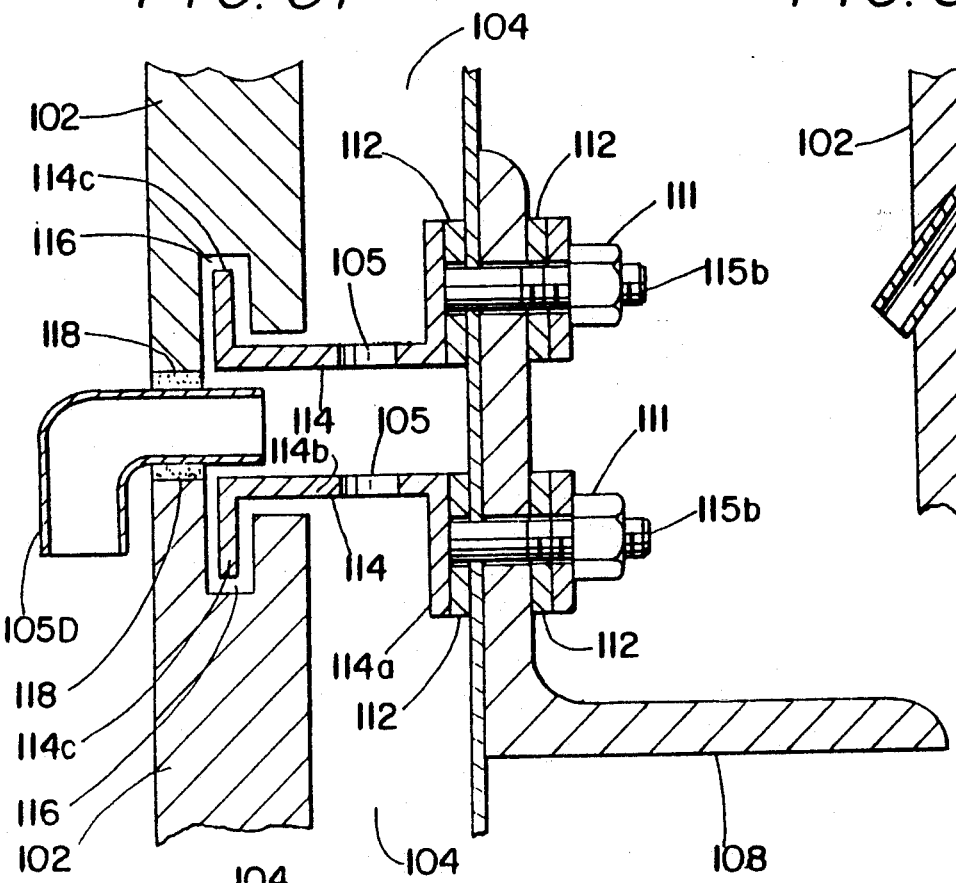
FIG. 58
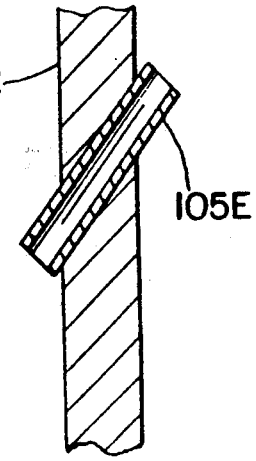
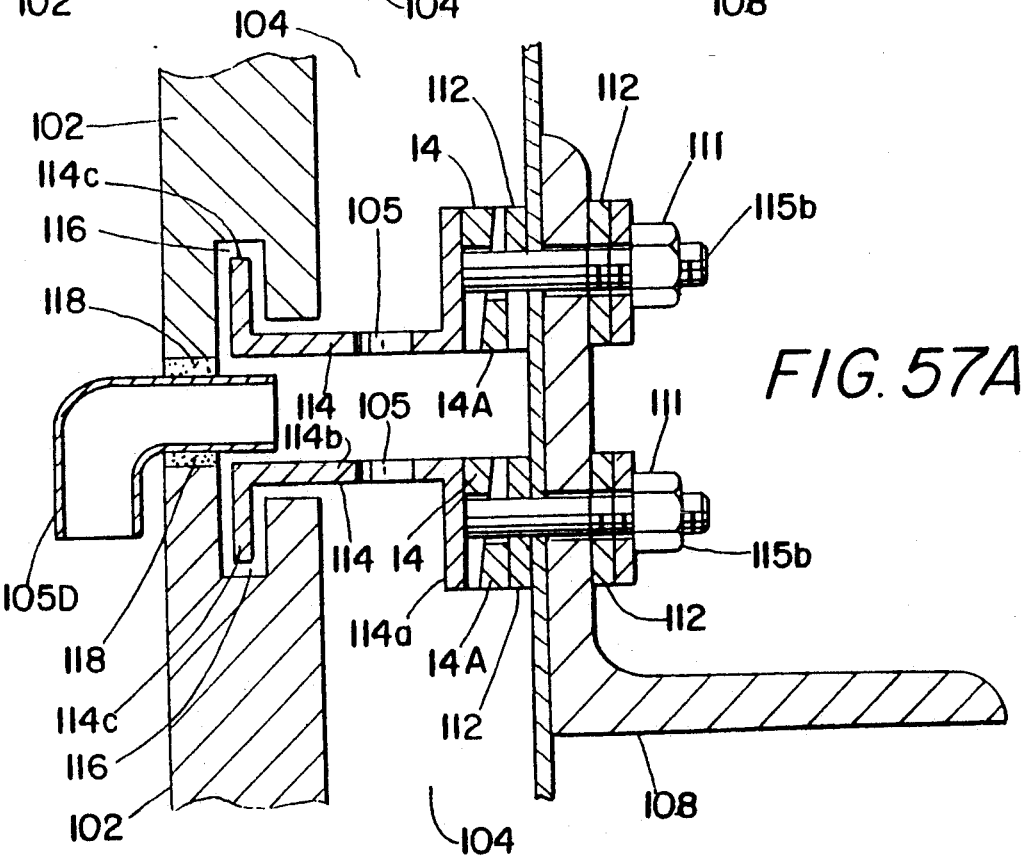
FIG. 57A

EXTERNAL WALL PANEL AND MOUNTING STRUCTURE THEREOF

This is a continuation-in-part of prior applications Ser. No. 07/346,884, filed May 3, 1989, , and Ser. No. 07/504,556, filed Apr. 3, 1990, both now abandoned.

BACKGROUND OF THE INVENTION

1. Field of the Invention

This invention relates in general to the field of lightweight wall curtains for multi-story buildings and, particularly, to the construction and mounting of individual wall curtain panels on the framework of a building to sheath the building framework and to provide finished, decorative, and waterproof building exterior walls.

2. Description of the Prior Art

Various materials are used to sheath building frames, such as stone, including granite and marble, ceramic tile, glass and metal sheet or plate. Such materials as marble are cut to uniform size and are bonded to metal backing plates. The metal backing plates are then fastened to building frame members to provide an exterior cover for the building.

This method of sheathing buildings is unsatisfactory in that solid slabs, such as granite, marble, or the like, bonded to steel backing plates remarkably increase the weight of the building, and the rigidity of the slabs renders the building walls vulnerable to cracking when subjected to earthquake tremors. Further, the coefficient of expansion for marble, for instance, is different from the coefficient of expansion of steel backing plate. Therefore, as the temperature of the marble and of the steel changes, there is danger of the entire panel warping due to differential expansion and contraction of the two bonded materials. A warped panel can cause the marble or like material to crack; it can cause the sealant between panels to become dislodged; and it can cause leaking between panels. Dislodged sealant has also been known to leach over the exterior face of the panel, thereby spoiling the general appearance of the building. The modulus of heat conductivity and coefficient of expansion of steel backing plates are both high, and it is difficult to effectively insulate steel backing plates when bonded to the exterior facing material.

SUMMARY OF THE INVENTION

The subject invention relates to a wall panel for multistoried buildings comprising exterior panel segments of stone, glass, ceramic or metal sheet. These panel segments are mounted on lightweight metal frames in a manner to provide insulating air spaces therebetween. The frames are covered with rustproof light-gauge metal skins to which the panel segments are attached.

In a preferred embodiment of the invention, threaded studs or bolts are secured to the backsides of the panel segments and means are provided to fasten the free ends of these studs or bolts to the panel frames. Spacers may be sandwiched between the panel segments and the frames to provide an isopiestic space therebetween.

In another embodiment of the invention, specially designed furring strips are used to secure the panel segments to the panel frames. The furring strips are adapted to make engagement with grooves in the upper and lower edges of the panel segments in such a manner as to secure the panel segments to their respective frames while at the same time spacing the panels away from and parallel to the frames to provide the isopiestic insulating air space therebetween.

The panel frames are provided with fasteners adapted to secure the frames to a building frame. For ease of mounting and alignment, the fasteners provide a capacity for three-dimensional adjustment which is advantageous both to compensate for building frame deformation and for alignment of individual panels with one another. Additionally, the fasteners are configured to render the panels, and hence the entire building, more earthquake resistant than would be the case if the building were sheathed with rigidly secured wall panels. The fact that the panel segment/frame combination of the subject invention is much lighter in weight than conventional steel plate reinforced wall panels also contributes to improve earthquake resistance of the building.

The panels are spaced apart to provide interstices therebetween which permit thermal expansion between the panels. It is optional whether the interstices are filled with sealant. If sealant is omitted, there is no danger of water damage because penetrating moisture is intercepted by the rustproof metal skins secured to the exterior sides of the panel frames.

In the embodiment of the invention using anchor bolts in lieu of furring strips, the heads of the bolts are embedded in the backsides or top and bottom edges of the panel segments to project normally inwardly through appropriate holes in the mounting frame. Threaded fasteners on the threaded free ends of the bolts lock the panel segments to their frames. With this arrangement, panel segments may be easily and safely mounted or removed by workmen from the inside of the building, without disturbing adjacent panel segments.

Because the lightweight panel mounting frames can be disconnected from their respective panel segments, the mounting frames may be separately mounted on the building structure, whereupon they are easily adjusted and aligned. The panel segments are then secured to the frames. With prior art wall panel slabs which are permanently bonded to steel backing plates, the entire assembly must be hoisted into place, secured and adjusted as one piece. It is also noted that prior art bonding of stone slabs to steel backing plates requires a cementitious semi-liquid bonding material which is expensive, time consuming in application, and equipment intensive. The subject invention dispenses with such bonding means, and therefore avoids the disadvantages of this prior art wall panel and method of fabrication.

Another innovative feature of the subject invention is the formation of sash frames from extensions of the four sides of the sheet metal panel segments, thereby dispensing with the need for a separate sash member, and the need to mount and to seal a separate sash member.

Finally, with the use of the lightweight panel mounting frame of the subject invention, it is possible to mount an interior panel on the interior side of the mounting frame. Thus the exterior and interior walls of the building are simultaneously erected, thereby eliminating the necessity for additional wall studding usually installed to support interior wall panels.

OBJECTS OF THE INVENTION

It is among the objects of the invention to provide a building wall panel comprising: an exterior panel sheet or panel segment releasably connectable to a lightweight metal mounting frame; a building wall panel having an insulation air space between an exterior panel sheet or panel segment and a lightweight metal mounting frame; means to quickly secure an easily and universally adjustable metal mounting frame to a building frame; an exterior panel sheet or panel segment, a mounting frame, and novel connecting means therebetween; novel connecting means between a wall panel or panel segment and a mounting frame and a building frame adapted to render not only the wall panel, but the entire building, earthquake resistant; an exterior wall panel sheet or panel segment which is secured to a mounting frame without the use of a cementitious material; exterior panel sheets having sash frame portions as extensions of the four sides of the panel sheets; a mounting frame adapted to mount an exterior wall panel sheet or panel segment on the exterior side of the mounting frame and further adapted to mount an interior panel sheet on the interior side of the mounting frame.

The foregoing and other objects, features, and advantages of the invention will become apparent from the detailed description set forth hereinafter when considered in conjunction with the accompanying drawings.

BRIEF DESCRIPTION OF THE DRAWINGS

FIG. 57 is an enlarged fragmentary cross-sectional view of yet another embodiment of a joint portion of another preferred embodiment of the invention;

FIG. 57A is an enlarged fragmentary cross-sectional view of the joint portion shown in FIG. 57 and including wedge adjusting means; and FIG. 58 is an enlarged fragmentary view of cross-sectional view of an alternate means of ventilating the inventive panel.

DESCRIPTION OF THE PREFERRED EMBODIMENTS OF THE INVENTION

An external wall panel P and a mounting structure thereof will be hereinafter described on the basis of illustrated embodiments.

Figure 1:
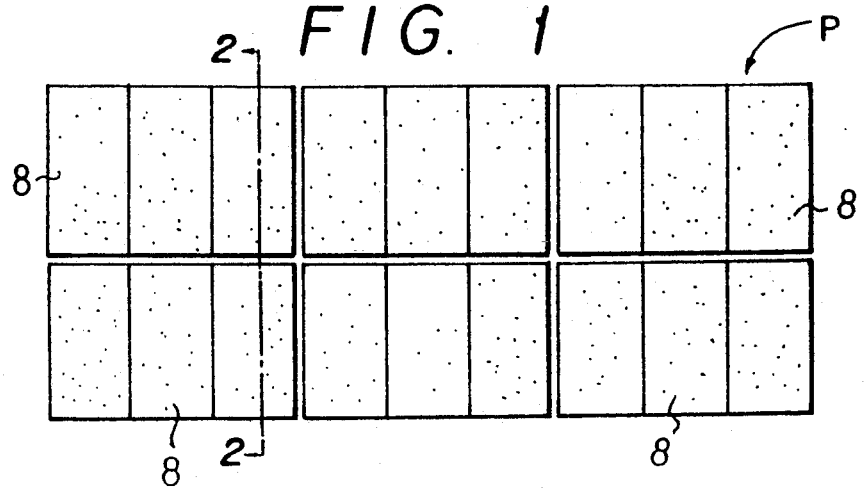
FIG. 1 is a front elevational view of exterior panels of a building in accordance with the invention.
Figure 2:
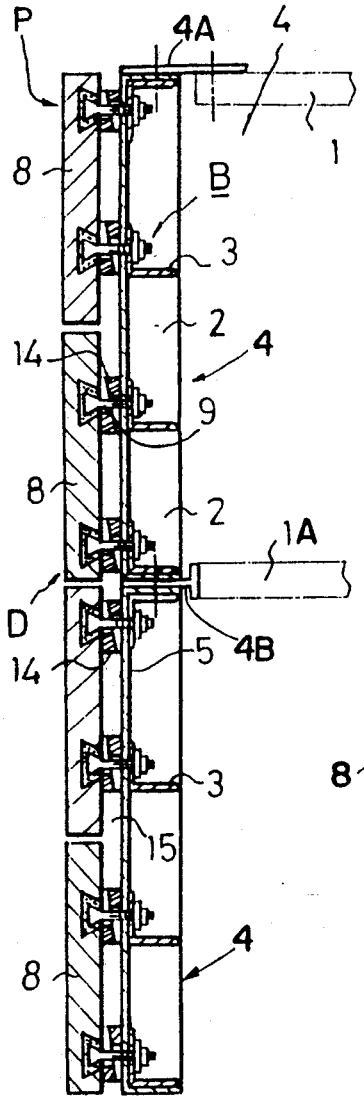
FIG. 2 is a sectional elevational view taken along the line 2—2 of FIG. 1.

FIGS. 1 through 8 illustrate a first embodiment according to the present invention. A mounting frame 4 (FIGS. 4 through 6) is so structured that a plurality of vertical frame members 2 and 2A and horizontal frame members 3 and 3A, which are made of lightweight angle steel, are formed in the shape of a lattice to extend between upper and lower slabs 1 and 1A, respectively, of a building (FIG. 2). The vertical and horizontal frame members 2, 3 are integrally connected with each other, preferably by means of welding. The mounting frame 4 is formed into a substantially rectangular shape of such size that its height corresponds to the height of a story of the building. A rustproof steel sheet 5 is attached to the surface of the mounting frame 4, also by means of welding, so as to overlay the mounting frame surface. A plurality of bolt holes 6 are formed in the vertical and horizontal frame members 2, 2A, 3, and 3A.

The bolt holes 6 are also formed in the rustproof steel sheet 5, so that each of the bolt holes 6 formed in the vertical and horizontal frame members and corresponding holes formed in the rustproof steel sheet are continuous to completely extend as one hole. Further, waterproof gaskets 7, FIG. 3, interposed between the vertical and horizontal frame members 2, 2A, 3, and 3A and the rustproof steel sheet or plate 5, are located about each of the bolt holes 6 to prevent rain water from infiltrating into the interior side of the wall panel P through the bolt holes 6. The mounting frame 4 thus structured is fastened by bolts to the upper and lower slabs 1 and 1A (FIG. 2), respectively, with brackets 4A and 4B.

Figure 3:
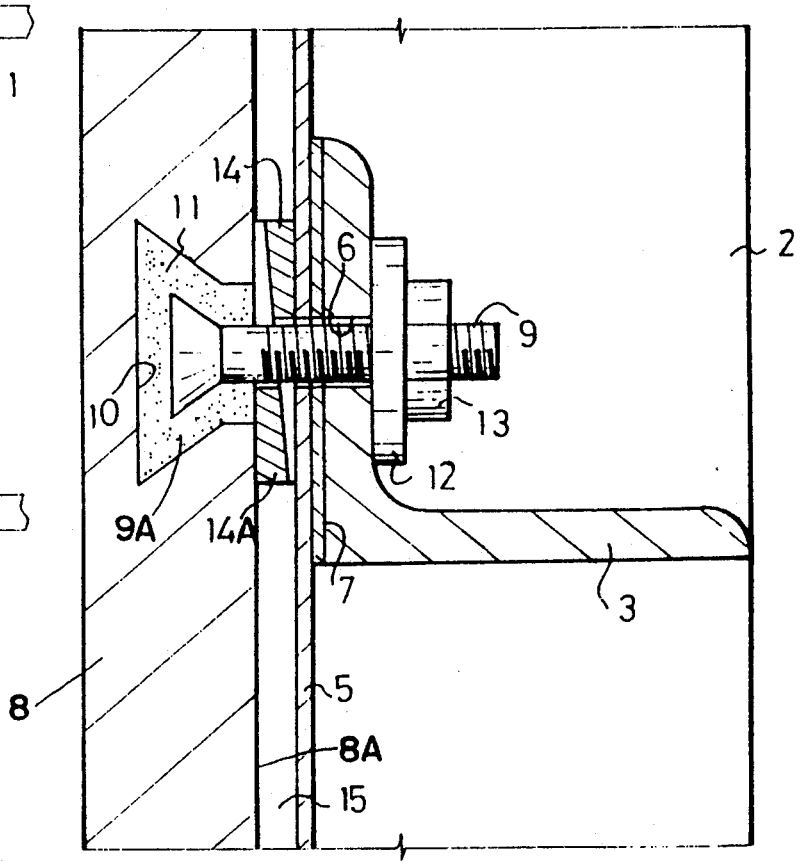
FIG. 3 is an enlarged fragmentary elevational view in section showing a portion of FIG. 2 indicated at B.
Figure 3A:
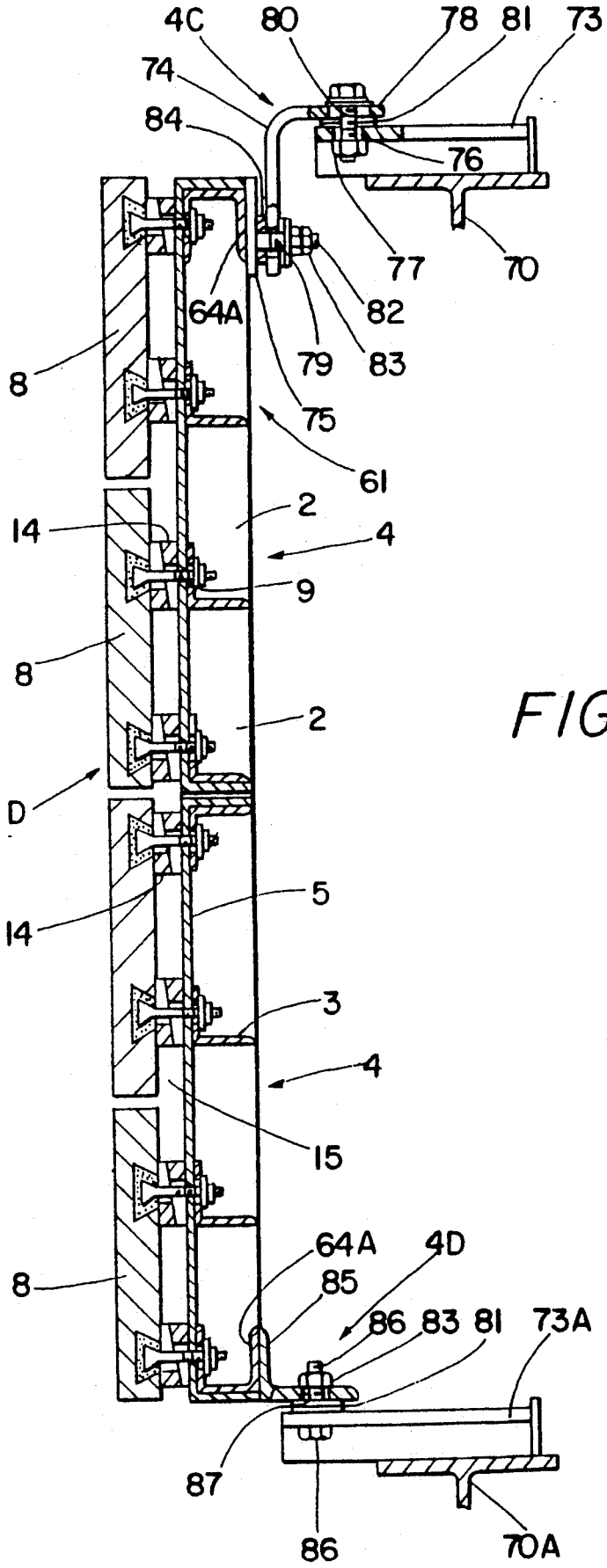
FIG. 3A is a sectional elevational view similar to FIG. 2 with adjustable seismic tremor resistant mounting brackets.
Figure 4:
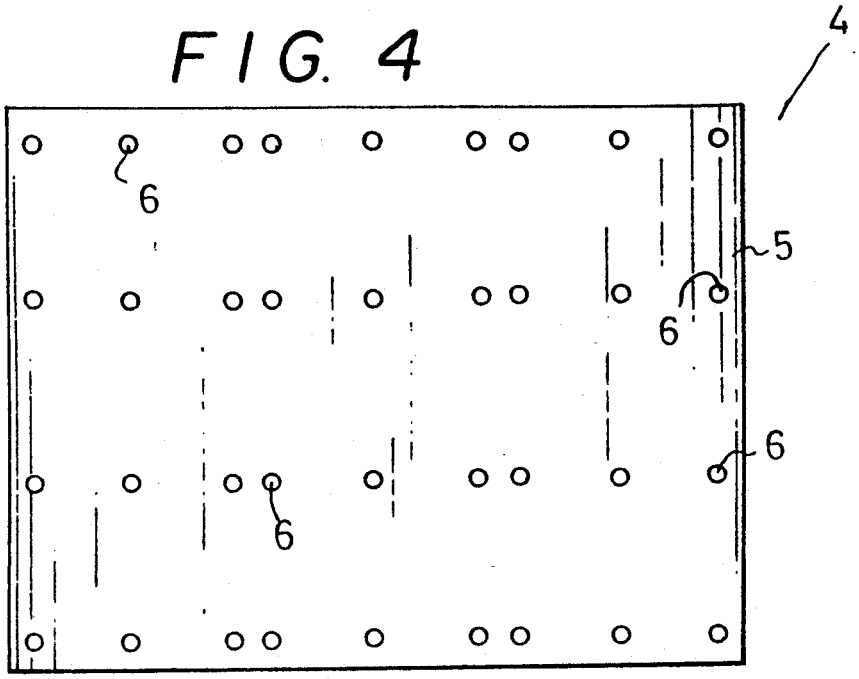
FIG. 4 is a front elevational view showing a panel mounting frame.
Figure 5:
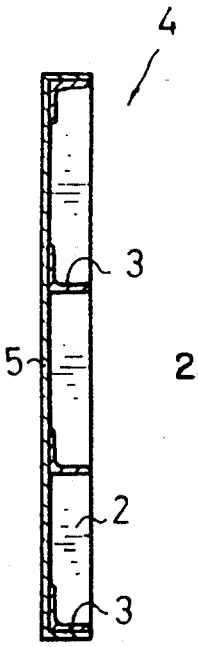
FIG. 5 is an elevational view in section taken along the line 5—5 of FIG. 6.
Figure 6:
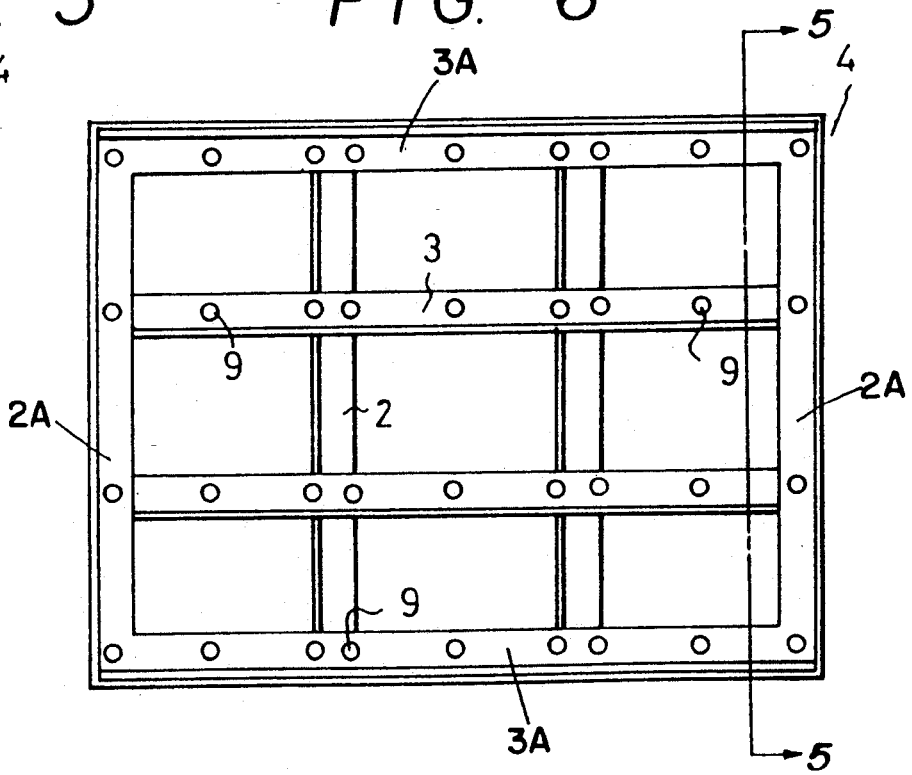
FIG. 6 is an elevational view of the interior side of the panel mounting frame of FIG. 4.

In the preferred embodiment of the mounting frames 4 shown in FIG. 3A, bracket means 4C and 4D are provided to secure the frames to upper beam 70 and lower beam 70A, respectively, of a building. The upper fastener 4C consists of an anchor fitting 73, a connection fitting 74, and a receiver fitting 75. Each anchor fitting 73 is welded to the upper surfaces of the upper and lower beams 70 and 70A, respectively, at uniform intervals along the beams. The mounting distance between the adjacent anchor fittings 73 corresponds to the widths of panel segments 8. A vertically extending mounting hole 76 is provided in a horizontal portion of the anchor fitting 73 and a mounting nut 77 is welded to the backside of the mounting hole 76. The connection fitting 74 is formed by bending a rectangular plate into an L-like shape and has mounting holes 78 and 79 provided in horizontal and vertical portions, respectively. The mounting hole 78 provided in the horizontal portion is radially over-size, while the mounting hole 79 in the vertical portion is horizontally elongated. The connection fitting 74 thus formed is fixedly attached to the anchor fitting 73 by mounting the horizontal portion of the connection fitting 74 on the horizontal portion of the anchor fitting 73 so as to overlap the mounting holes 76, 78, and threading a mounting bolt 80 into the mounting nut 77 through the mounting holes 76 and 78 of the anchor fitting 73 and the connection fitting 74, respectively. Since the mounting hole 78 of the connection fitting 74 is radially over-size and the mounting hole 79 thereof is horizontally elongated, the connection fitting 74 is easily positioned and hence the upper end of the external wall panel P may be easily positioned and secured to anchor fitting 73. Further, by interposing a plurality of washers 81 between the horizontal underside portion of the connection fitting 74 and the topside of the anchor fitting 73, the level adjustment of the fitting 74 may be easily made. Accordingly, the level adjustment of the external wall panel P may also be easily made.

Since the connection fitting 74 is formed of elastoplastic metal, the fitting 74 is formed as shown in FIG. 3A to absorb unexpected external forces, such as earthquake tremors. It is therefore possible to avoid damaging the mounting portion of the external wall panel P and hence the external wall panel itself.

The receiver fitting 75 is attached to left and right opposite sides of the lightweight channel steel member 64*a* at the upper end of the external wall panel P by means of welding. A mounting bolt 82 is provided on the exposed side of the receiver fitting 75 so as to horizontally project therefrom. The mounting bolt 82 of the receiver fitting 75 extends through the mounting hole 79 of the connection fitting 74 and a nut 83 is screwed onto the threaded portion of the mounting bolt 82 to thereby secure the upper end of the external wall panel P in position. An elastic packing 84 made of synthetic rubber or the like is interposed between the vertical portion of the connection fitting 74 and the receiver fitting 75.

The lower fastener 4D consists of an anchor fitting 73A and a connection fitting 85. A mounting bolt head 86A of bolt 86 is welded to the underside of anchor fitting 73A, concentric with mounting hole 76 of the anchor fitting 73 so as to vertically align bolt 86 with the threaded portion projecting upwardly. The connection fittings 85 are attached to left and right opposite ends of the lightweight channel steel member 64*a* lower end of the exterior wall panel P by means of welding. The connection fitting 85 is made of angle steel or like material and has a vertically extending, over-size mounting hole 87 bored in a horizontal portion of the connection fitting 85. In the structure as noted above, the lower end of the external wall panel P is fixed in position by centering hole 87 over bolt 86 and then lowering the horizontal flange portion of fitting 85 over the mounting bolt 86 until it projects through mounting hole 87 of the connection fitting 85. A nut 83 is then threaded onto the threaded portion of mounting bolt 86. Since the mounting hole 87 of the connection fitting 85 is over-size, the horizontal flange portion of fitting 85 is easily fitted over bolt 86. The right angle relationship between the vertical and horizontal flange portions of fitting 85 enables the fitting 85 to be able to absorb unexpected external forces, such as earthquake tremors.

Figure 7:
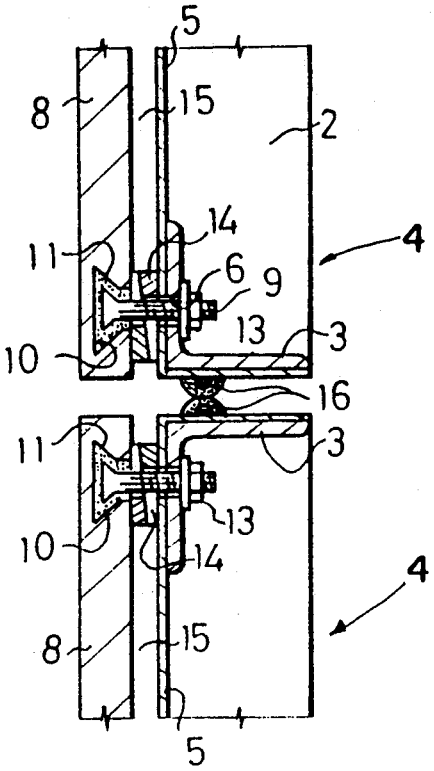
FIG. 7 is an enlarged fragmentary sectional view showing the portion indicated at D on FIG. 2.

When appropriate, a plurality of mounting frames 4 may be connected to each other in the horizontal direction of the slabs 1 and 1A, and a rubber gasket or other packing material 16 is interposed between the adjacent upper and lower mounting frames 4 (FIG. 7).

A plurality of external metal, ceramic, glass, or stone wall panel segments 8, FIGS. 1 and 2, are attached to the mounting frame 4. The external wall panel segments 8 attached to the mounting frame surface are formed in rectangular array corresponding to the height of a story of the building to which the panels are attached.

A plurality of anchor bolts 9 (FIG. 3) are rigidly cemented on the backside of external wall panel segments 8 so as to project normally inward. The mounting of each of the anchor bolts 9 is accomplished by forming small holes 10, FIG. 3, in the backsides 8A of the external wall panel segments 8, inserting the cap ends 9A of the anchor bolts 9 into the small holes 10 and filling the holes 10 with resin mortar 11. Each external wall panel segment 8 is mounted on the mounting frame 4 by inserting anchor bolts 9 through the corresponding bolt holes 6 of the mounting frame 4, mounting a washer 12 on the free end of each anchor bolt 9 and then threadedly fastening a nut 13 onto the free end of each anchor bolt 9.

Figure 8:
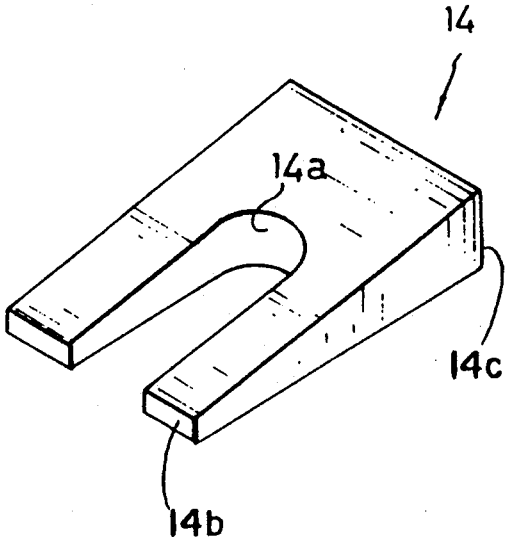
FIG. 8 is a perspective view showing a wedge used in FIG. 7.
Figure 9:
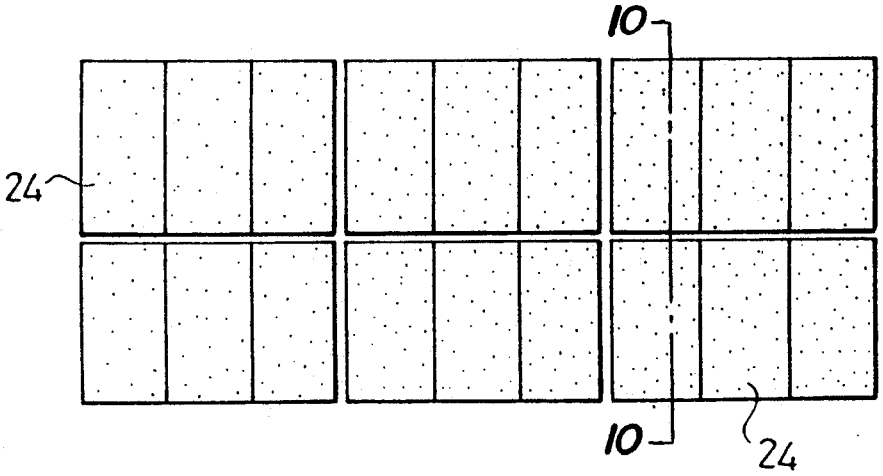
FIG. 9 is a front elevational view showing another mounting of external wall panels.

Wedges 14 and 14A are interposed between the rustproof steel sheet 5 and the external wall panel segments 8 to form a variable isopiestic space 15. The isopiestic space 15 functions to prevent rain water from penetrating to the interior side of the panel P by permitting air pressure in this isopiestic space to equal atmospheric pressure. The isopiestic space 15 also functions as a ventilation space through which outside air circulates and prevents condensation. Each wedge 14, FIG. 8, is formed with an elongate groove **14*a* extending from the narrow edge end 14*b* of the wedge toward the wide edge 14*c* thereof. The wedge 14 is fixed in position by fitting the grooved portion 14*a* over the anchor bolt 9 (FIGS. 3 and 8**).

A second embodiment of the present invention will now be described with reference to FIGS. 9 through 14. A mounting frame 20 (FIGS. 10 and 11) is so structured that a plurality of vertical frame members 18 and horizontal frame members 19, which are made of lightweight angle steel, are framed into the form of a lattice between upper and lower 17 and 17A, respectively, of a building. The mounting frame 20 is fixedly attached to slabs 17 and 17A by means of welding or threaded fasteners and brackets, as shown in FIG. 2. The vertical and horizontal frame members 18 and 19 are also integrally assembled by means of welding or threaded fasteners. Further, a rustproof steel sheet or plate 21 is attached to the mounting frame 20 on the exterior side by means of welding. The surface of the rustproof steel sheet 21 on the interior is subjected to fireproof coating 21A, FIG. 10. A plurality of mounting holes 22 are formed in both of the vertical and horizontal frame members 18 and 19 and the rustproof steel sheet 21.

Waterproof packing 23 (FIG. 13) is interposed between the vertical and horizontal frame members 18, 19 and the rustproof steel sheet 21 and positioned to encircle each of the mounting holes 22. This waterproof packing prevents rain water from penetrating to the interior of the panel through mounting holes 22. A plurality of wall panel segments 24 made of stone, glass, large-sized tile or the like are mounted on the exterior side of the rustproof steel sheet 21 of the mounting frame 20. A plurality of anchor bolts 25 are mounted on upper and lower backside edge portions of external wall panels 24 to project normally therefrom. Each of the anchor bolts 25 is fixed in position to an external wall panel segment 24 by the steps of forming a dowel hole 26, which extends deep in the vertical direction of the external wall panel 24, in upper and lower edge portions of the external wall panel 24, inserting an anchor bolt base end 25A, FIG. 13, of the anchor bolt 25 into the dowel hole, and then filling the dowel hole with mortar, resin cement mortar or the like.

Each of the external wall panels 24 is attached to the mounting frame 20 by inserting the free ends 25B of the anchor bolts 25 through corresponding mounting holes 22 and mounting washers 28 on anchor bolt free ends 25B, and then screwing nuts 29 onto the anchor bolt free ends 25B. A plurality of wedges 30 are sandwiched between the mounting frame 20 and the external panel segments 24 in order to adjust the external panel segments 24 so as to be coplanar each with the other. By interposing wedges 30 between the mounting frame 20 and the external wall panel segments 24, an isopiestic space 31 is formed between the steel sheet 21 and the external panel segments 24. This isopiestic space 31 prevents rain water from penetrating internally beyond the isopiestic space 31. Further, by circulating air through the isopiestic space 31, moisture is prevented from penetrating between the external panel segments 24 and the mounting frame 20.

A third embodiment of the present invention will now be described with reference to FIGS. 15 through 27. First, a plurality of finished panel segments 33 made of tile, stone or the like are arranged in a row on a pallet 32 as shown in FIGS. 15 through 18. Each of the finished panel segments 33 is provided with upper and lower longitudinal grooves 34 and 34A of predetermined depth. The finished panel segment 33 is of such size that it may be easily carried by a workman.

Figure 25:
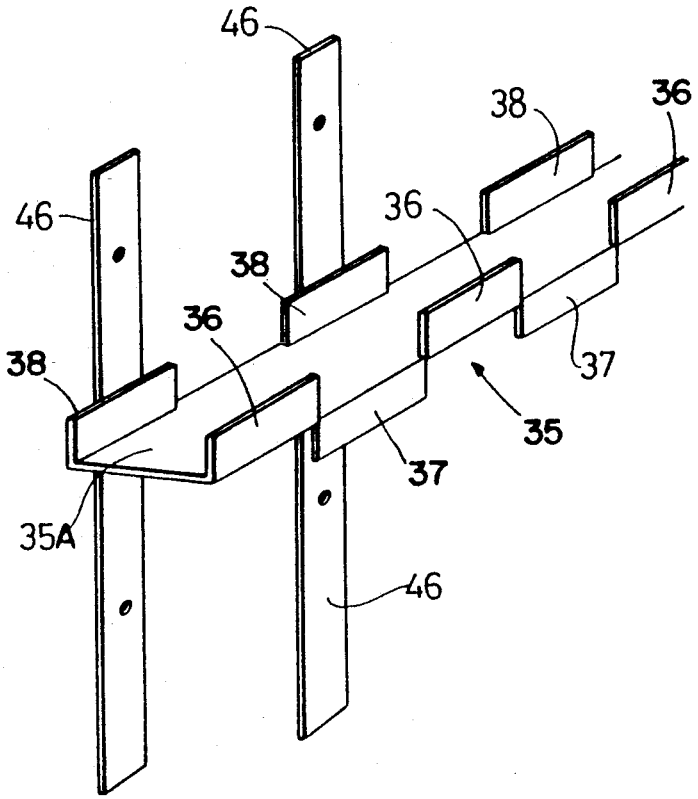
FIG. 25 is a perspective view showing the furring strip included in FIG. 24.

A furring strip 35, FIG. 25, comprises a flat, elongated, rectangular steel strip 35A, having upstanding rectangular edge tabs 36 alternating with depending rectangular edge tabs 37 along one longitudinal edge of steel strip 35A. Upstanding, rectangular edge tabs 38 alternate with depending rectangular edge tabs 38A, FIG. 20, along the opposite rectangular edge of steel strip 35A.

Figure 16:
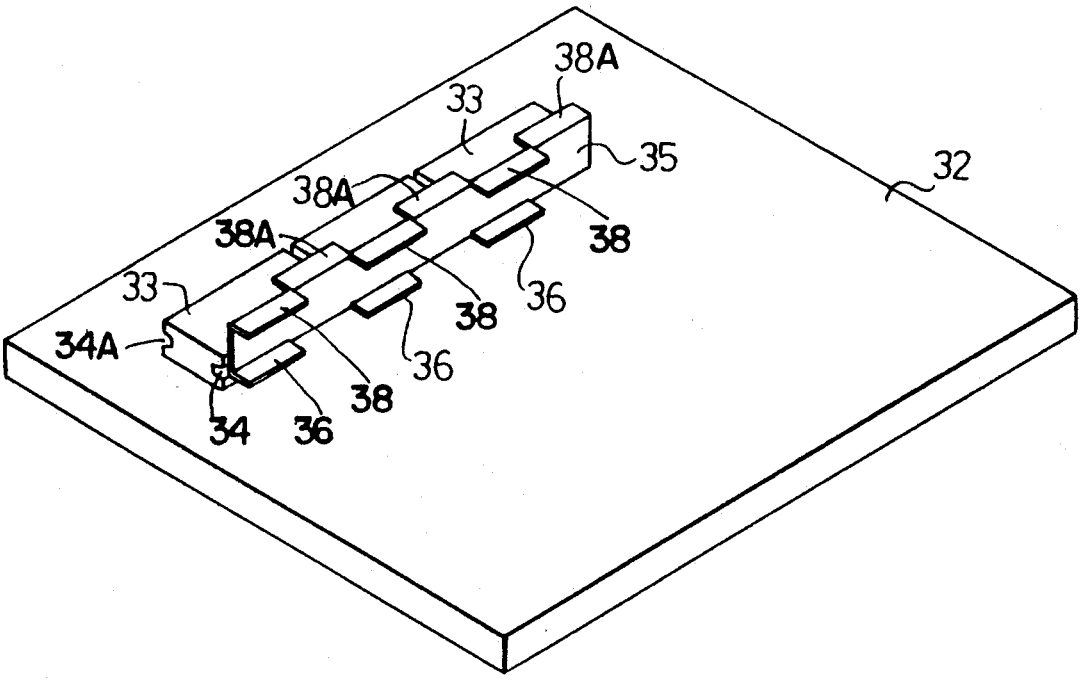
Figure 17:
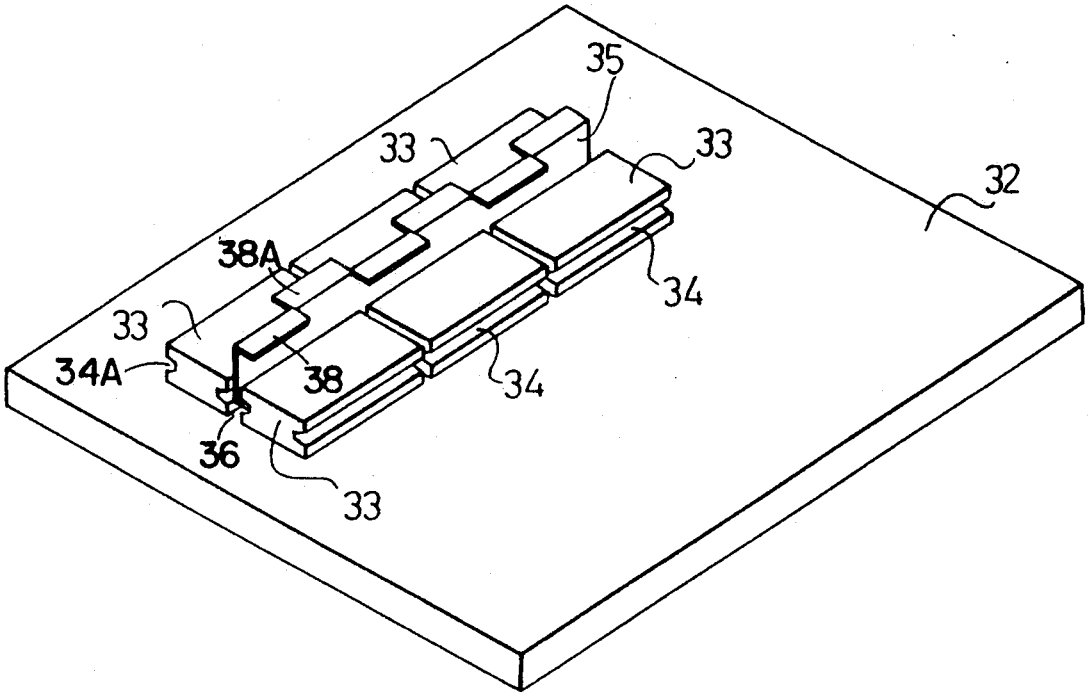

Depending rectangular edge tabs 37 of furring strip 35 are inserted into grooves 34, FIG. 16, and secured therein by filler such as synthetic resin or the like. Thereafter, a second row of panel segments 33 are positioned on the pallet 32 for engagement of upstanding rectangular edge tabs 36 with grooves 34 and then secured therein by the filler, FIG. 17. Additional rows of panel segments 33 and furring strips 35 are secured in like manner until a full panel P-2, FIG. 27, of predetermined size has been assembled. See also FIG. 18. A reinforcing frame 41 is then secured to the panel P-1, FIG. 19, to reinforce the panel and to protect the edges of the panel.

Figure 18:
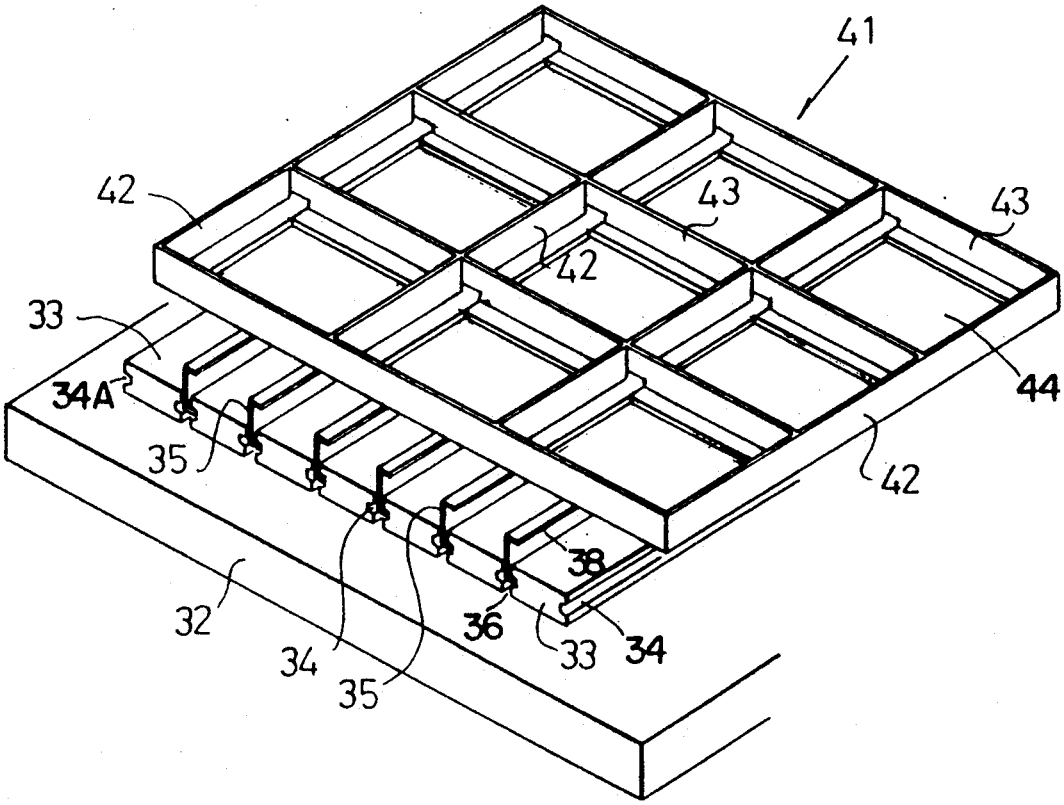

The frame 41 comprising a plurality of vertical and horizontal frame members 42 and 43, respectively, is made of lightweight angle steel and forms a lattice, FIG. 18. A metal sheet 44 is attached to one side of the lattice-like vertical and horizontal frame members 42 and 43 by means of welding or the like. The metal sheet 44 is subjected to fireproof and rustproof treatment. See FIG. 19. The frame 41, FIG. 21, is mounted on the furring strips 35 with mounting bolts 45 which integrally secure rectangular edge tabs 38 and 38A to frame lattice members 42 and 43.

Figure 21:
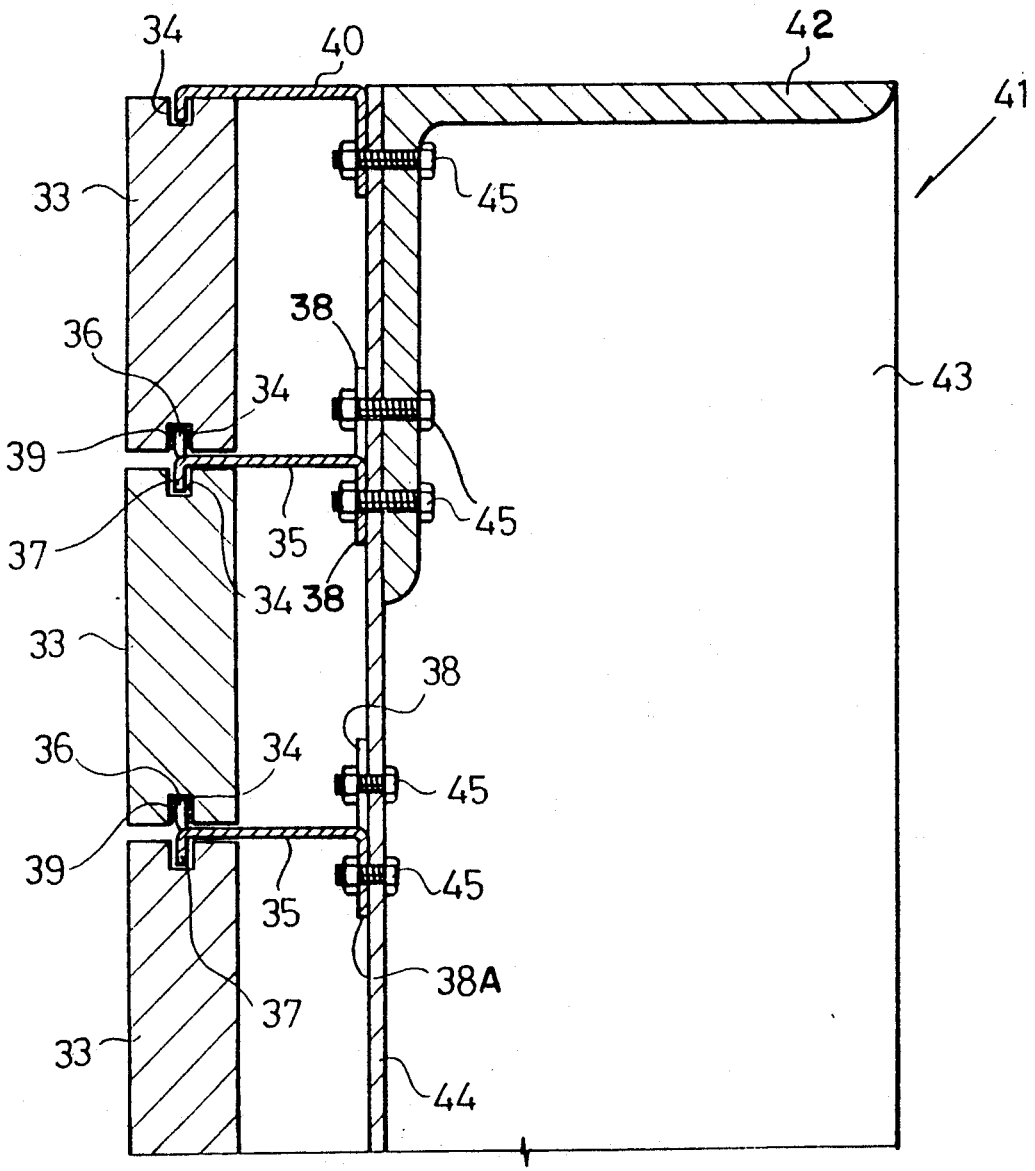
FIG. 21 is an enlarged fragmentary elevational view in section showing the upper portion of a preferred embodiment of the invention.
Figure 21A:
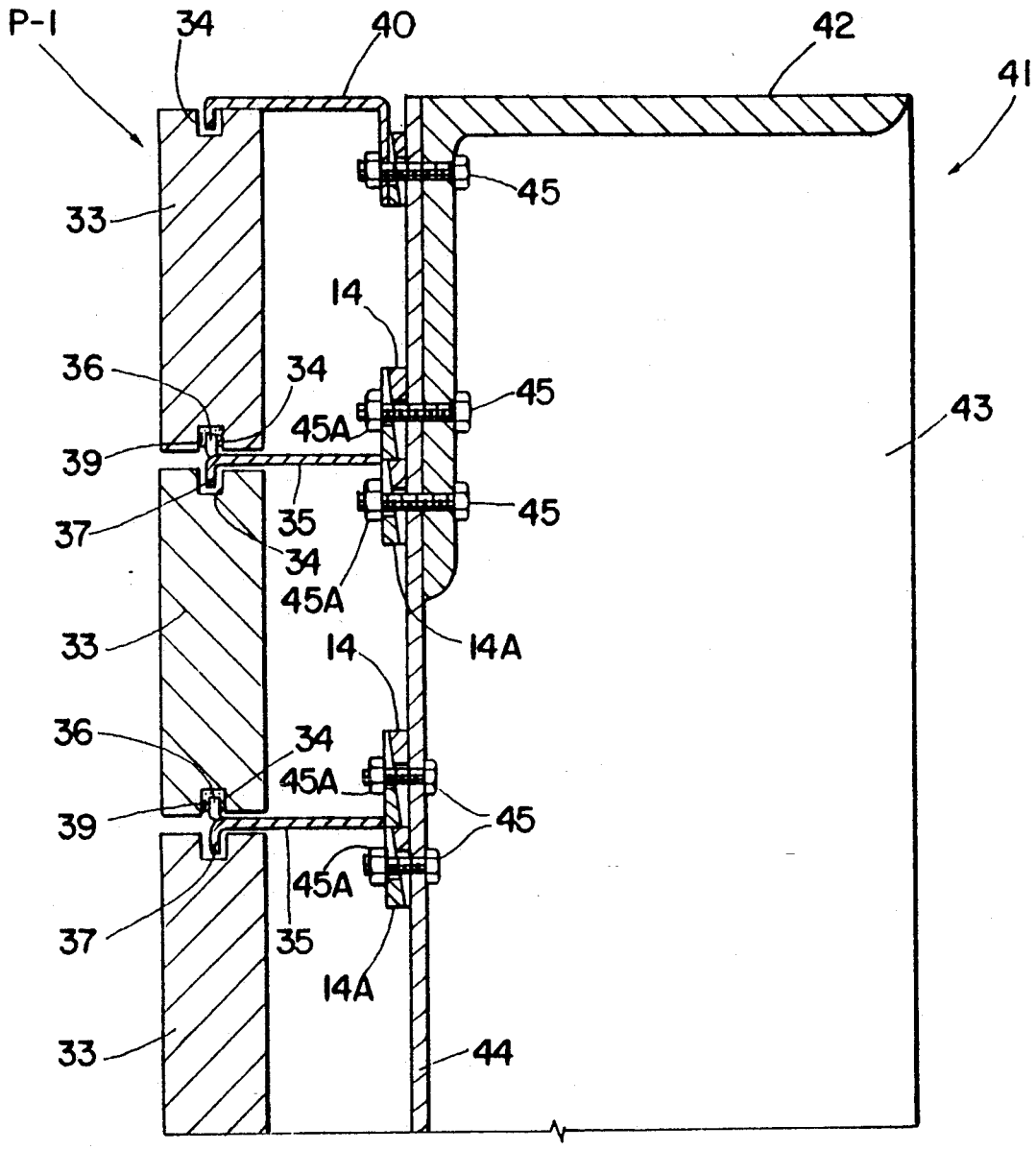
FIG. 21A is an enlarged fragmentary elevational view in section similar to FIG. 21 and including wedge adjusting means.

The embodiment of the invention shown in FIG. 21A is similar to that of FIG. 21, with the exception that wedges 14 and 14A are mounted on bolts 45 and sandwiched between metal sheet 44 and nuts 45A. By appropriately adjusting wedges 14 and 14A, panel P-1 may be shifted laterally to increase or decrease the isopiestic space between the panel segments 33 and the reinforcing frame 41. These wedges also permit correction for misalignment between panels or for building misalignment.

Figure 24:
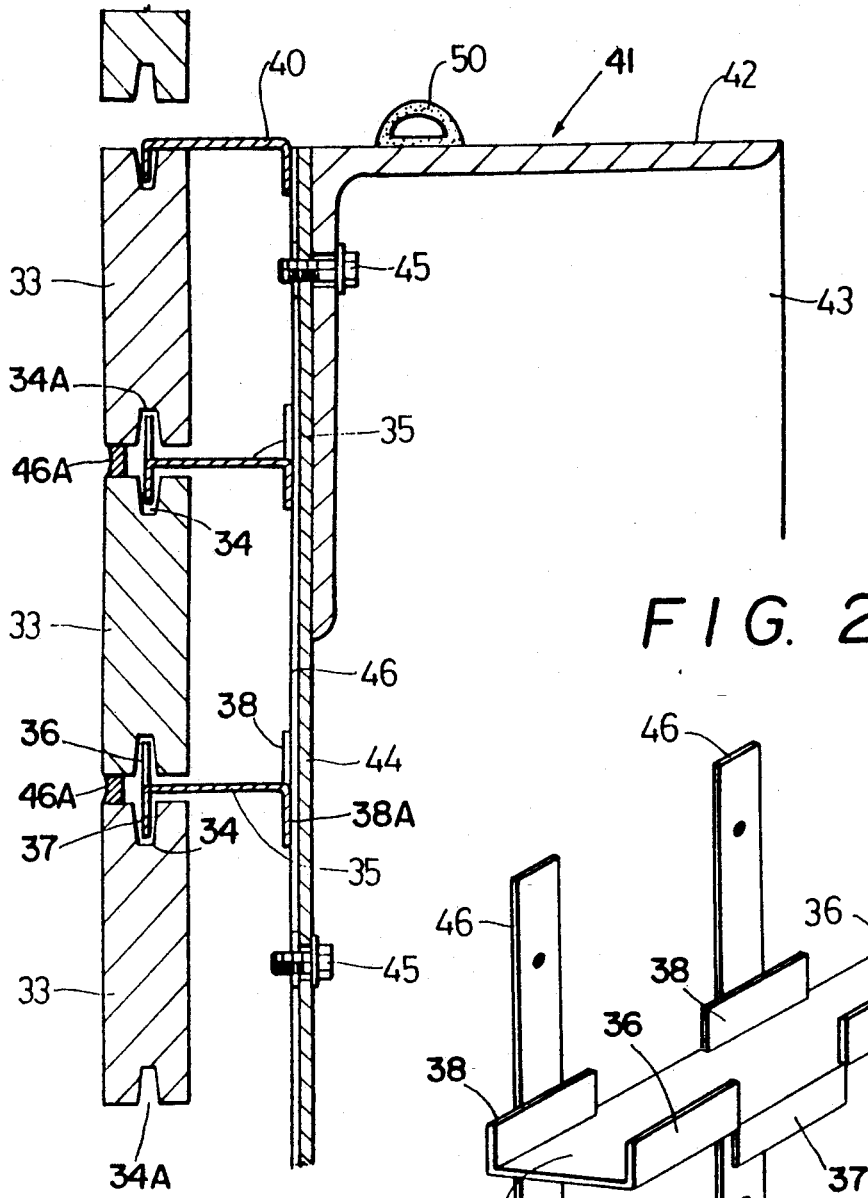
FIG. 24 is an enlarged fragmentary elevational view in section similar to FIG. 21 but showing use of the furring strip shown in FIG. 25.

In an alternative embodiment, to improve the rigidity of the panel as a whole, reinforcing strips 46 may be secured to the furring strips 35 at right angles thereto and to the frame 41 with mounting bolts 45 (FIGS. 24 and 25). Then, sealing strips 46A, FIG. 24, may be placed in the interstices between the adjacent finished panel segments 33 to form sealed joints therebetween, although unfilled interstices will suffice. The external panel thus structured is attached to floor slabs 48 and 48A (FIGS. 22 and 23) of a building with respective fasteners 49 and 49A. Gaskets 50 and 50A are mounted between the reinforcing frames 40 and 40A to form a water seal therebetween.

Figure 22:
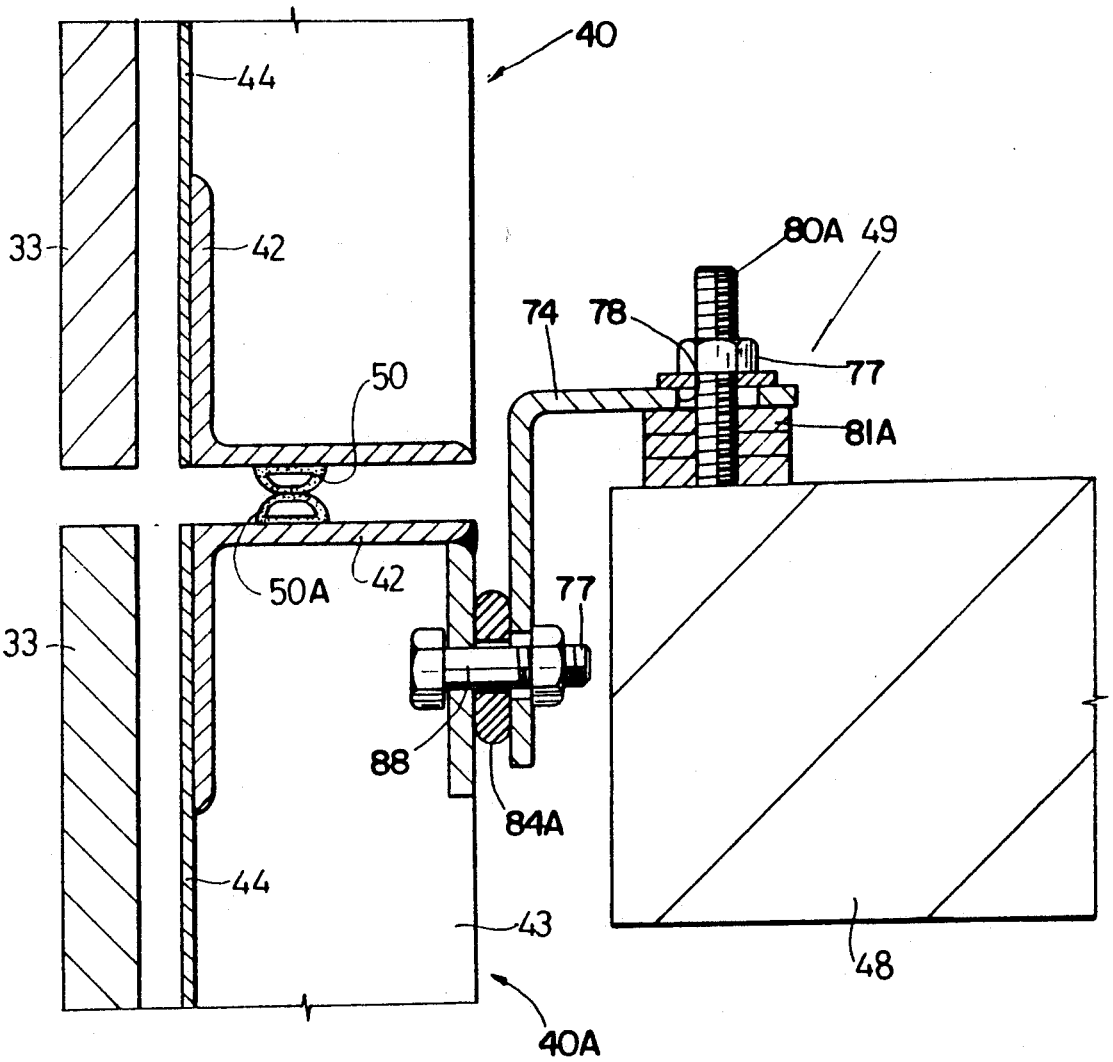
FIG. 22 is an enlarged fragmentary elevational view in section of a preferred embodiment of the invention showing means to secure the upper portion of a panel to a building frame structure.
Figure 22A:
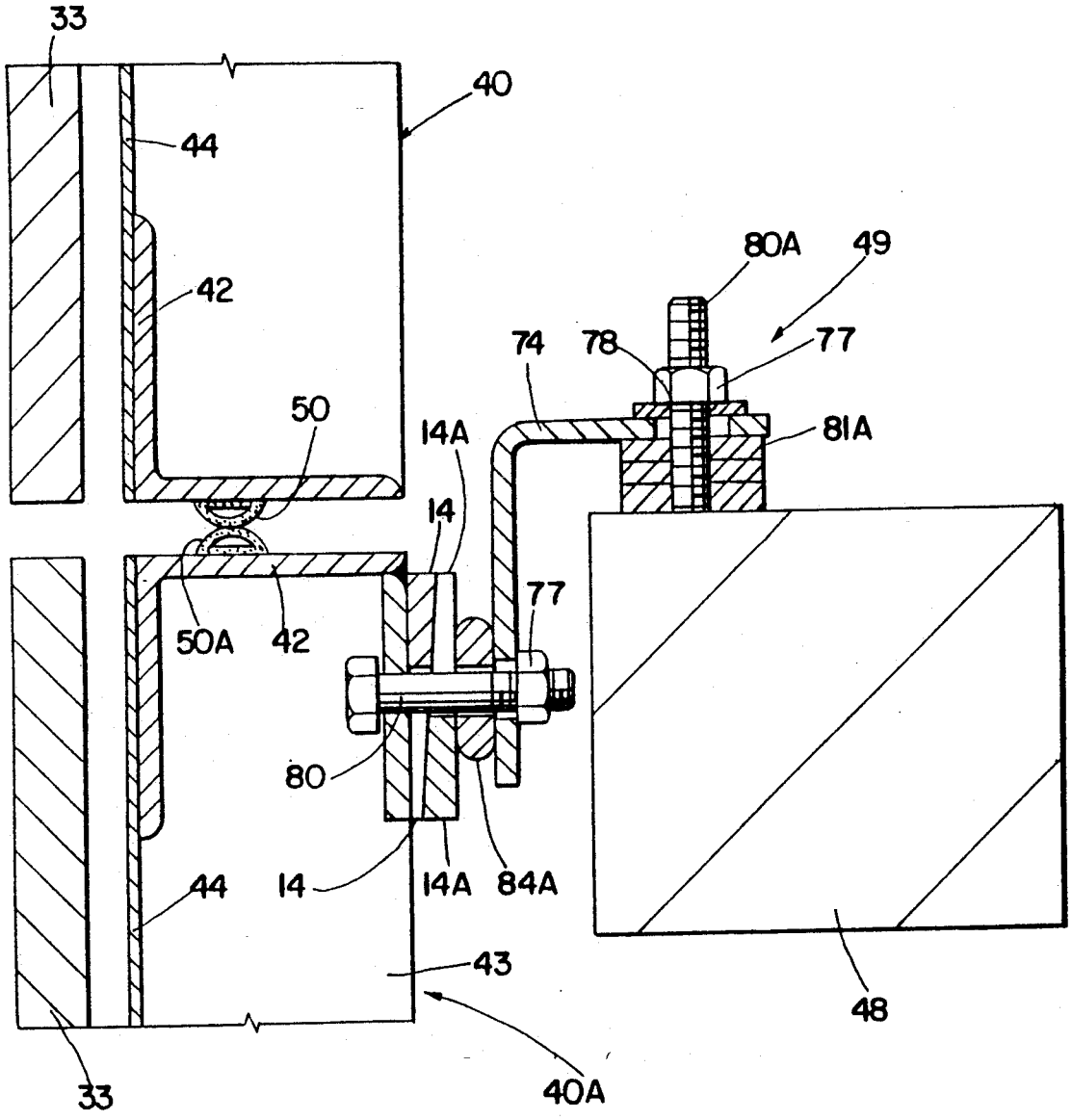
FIG. 22A is an enlarged fragmentary elevational view in section similar to FIG. 22 and including wedge adjusting means.
Figure 23:
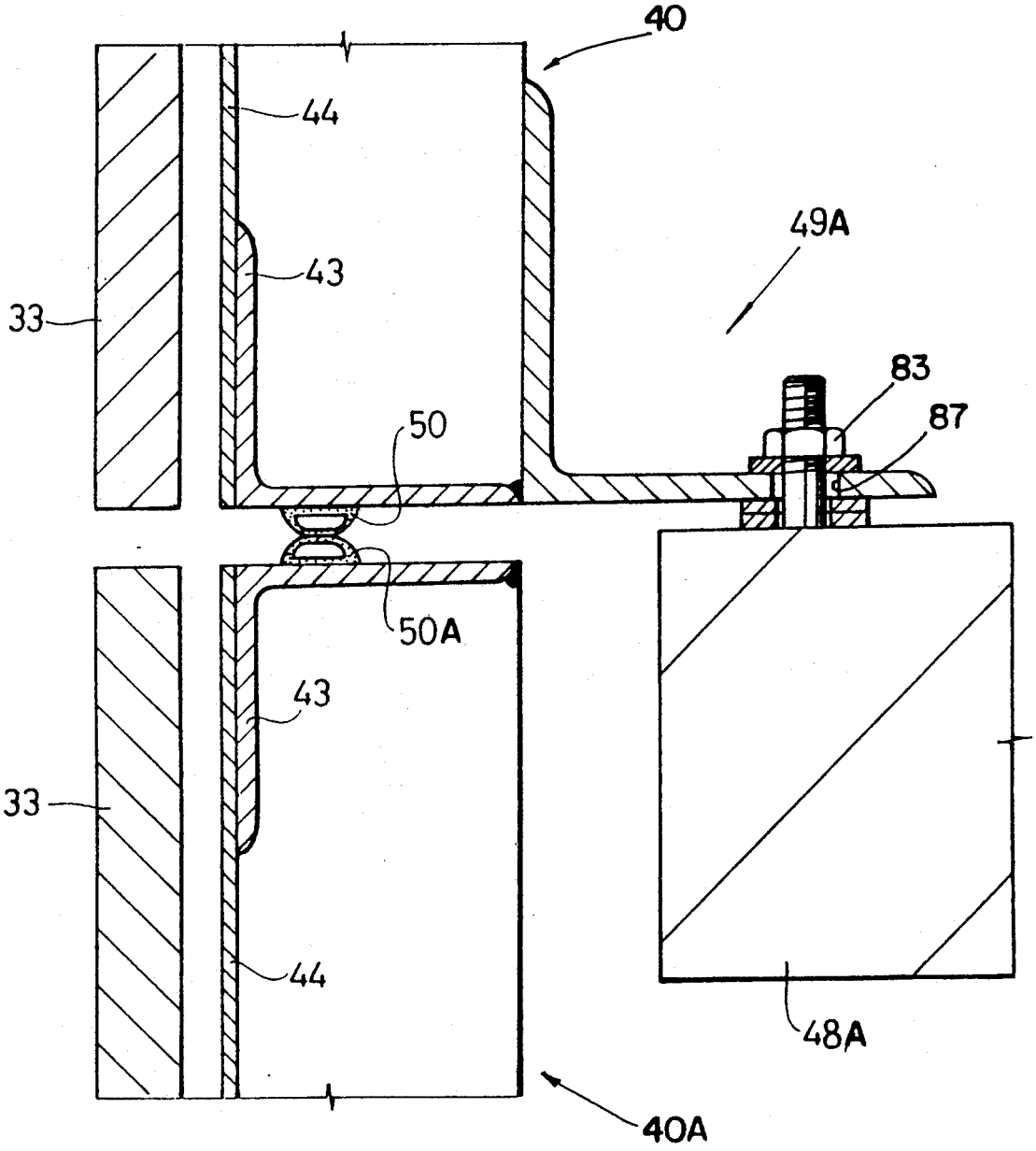
FIG. 23 is an enlarged fragmentary elevational view in section of the embodiment of FIG. 22, showing means to secure the lower portion of the panel to a building frame structure.

The embodiment of FIG. 22A is a modification of FIG. 22 to the extent that pairs of adjusting wedges 14-14A are mounted on bolts 80 and are sandwiched between channels 42 and the vertical legs of mounting brackets 74 and gaskets 84A.

Figure 26:
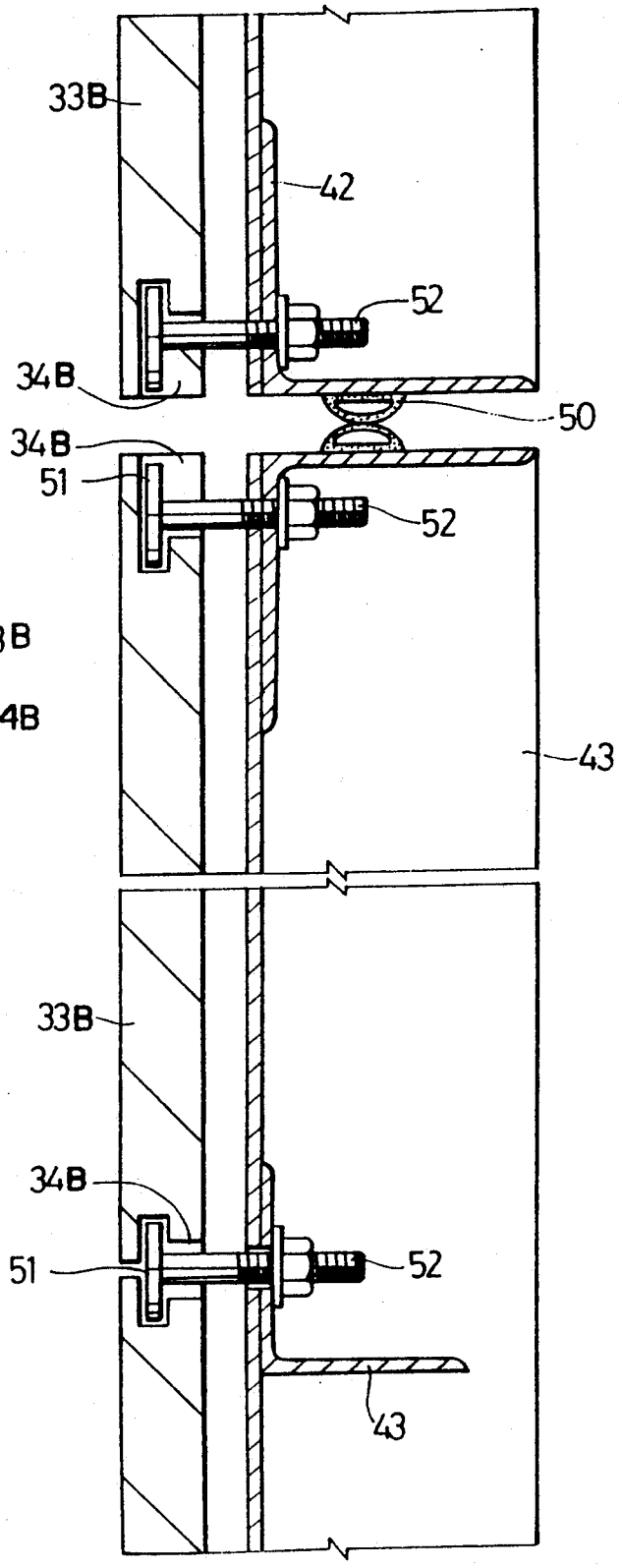
FIG. 26 is a fragmentary elevational view in section of abutting panels of an inventive curtain wall.
Figure 27:
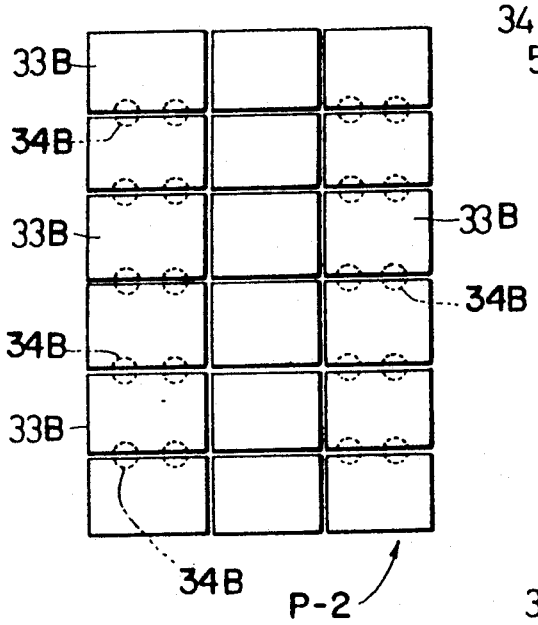
FIG. 27 is a front elevational view of the curtain wall shown in FIG. 26.

FIGS. 26 and 27 illustrate another embodiment of the present invention, in which a plurality of anchor bolts 52, each of which has a flanged head 51, are fitted into corresponding grooves 34B in the upper and lower edge portions of each finished panel segment 33B. Instead of the furring strip 35 of FIG. 25, lattice members 42 and 43 are connected directly to the anchor bolts 52.

Figure 27A:
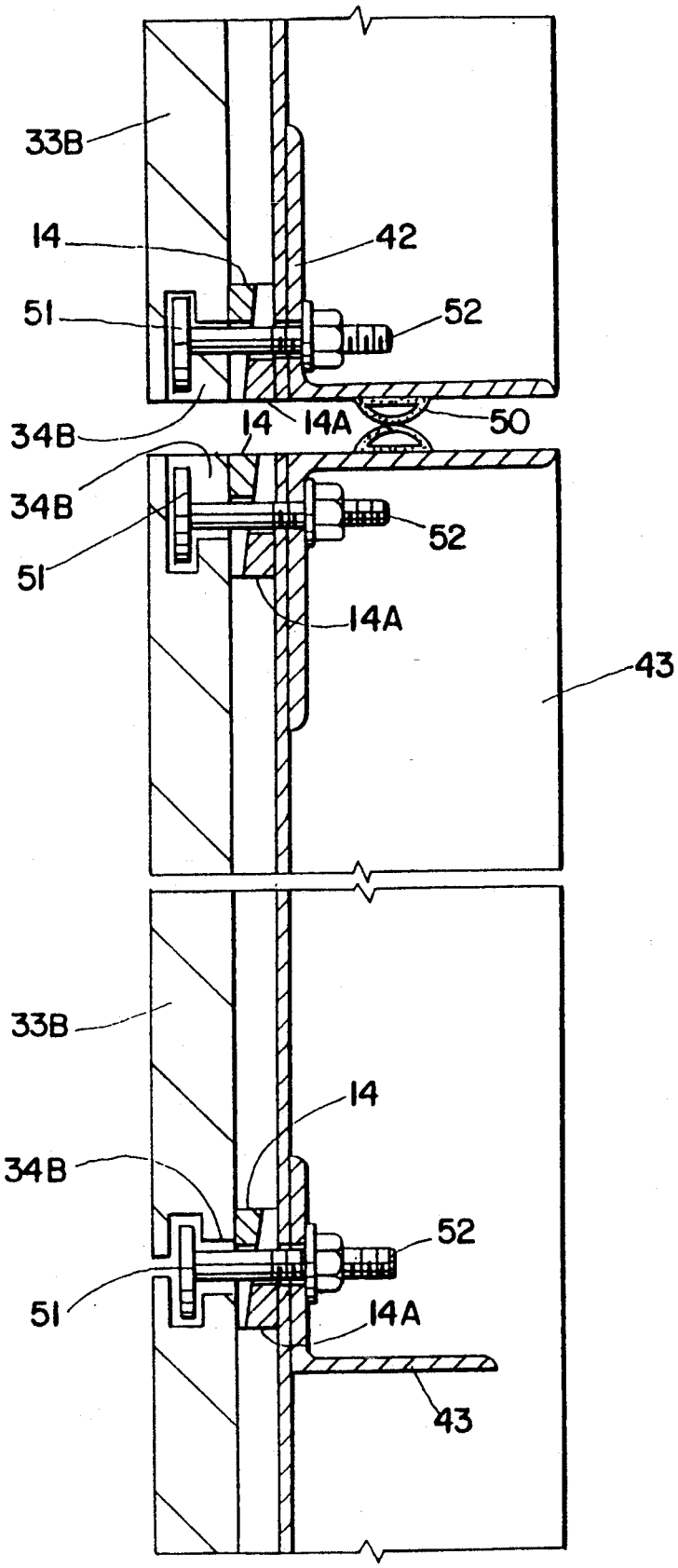
FIG. 27A is a fragmentary elevational view in section of abutting panels similar to FIG. 26 and including wedge adjusting means.

FIG. 27A is similar to FIG. 26 except that it is provided with adjusting wedges for the same purpose as described with reference to the embodiments of the invention shown in FIGS. 21A and 22A.

Figure 28:
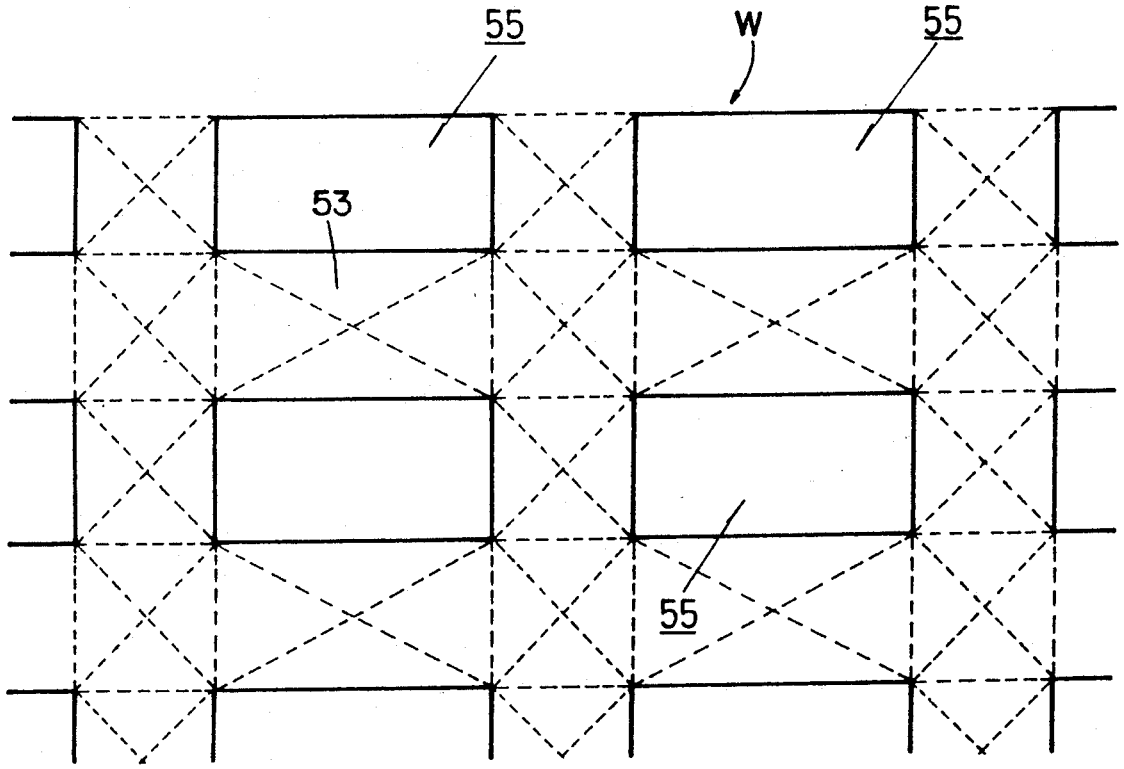
FIG. 28 is a fragmentary front elevational view showing a curtain wall with window sashes.
Figure 29:
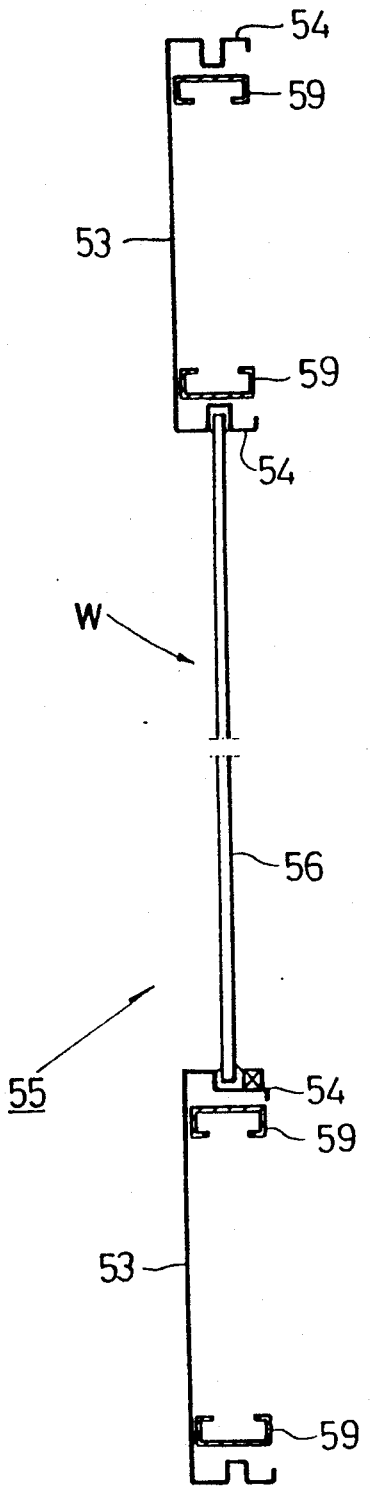
FIG. 29 is a fragmentary elevational view in section showing a window sash and window pane.
Figure 30:
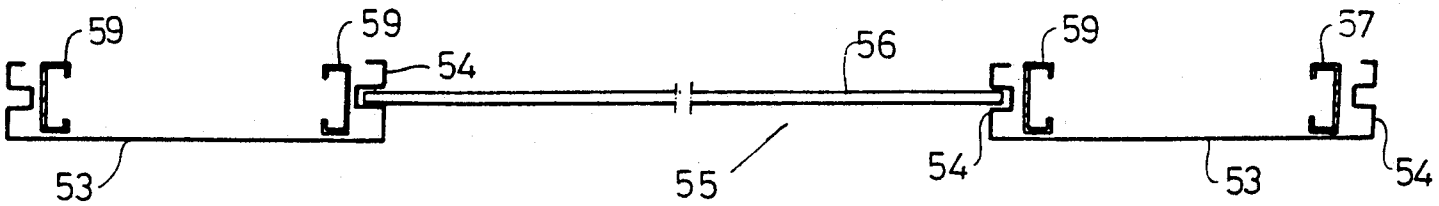
FIG. 30 is a plan view in section of the window sash and pane of FIG. 29.
Figure 31:
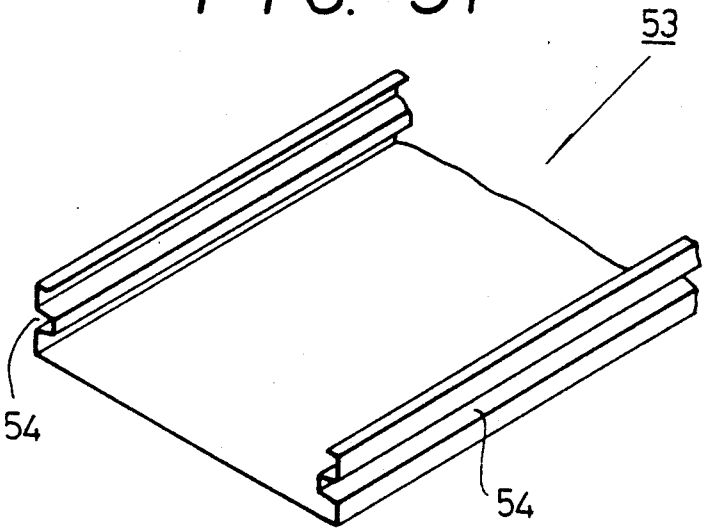
FIG. 31 is a perspective view showing a wall panel with window sash extensions.

A fourth embodiment of the present invention will now be described with reference to FIGS. 28 through 35. FIG. 28 illustrates a building wall W having wall openings 55 between wall panels 53. FIG. 29 is a fragmentary sectional elevation of building wall W which illustrates an opening 55 of the wall. Wall panel sheets 53 are formed of metal sheet such as aluminum, steel or the like into a rectangular shape. Sash frames 54 are formed in upper and lower edge portions or right and left edge portions, or both of upper and lower edge portions and right and left edge portions of the wall panels 53. Each of the sash frames 54 is formed by bending an edge of the wall panel sheet 53 into a predetermined sectional shape (FIG. 31). Each sash frame 54 may be formed into a required sectional shape. Other sash frames of various sectional shapes, as shown in FIGS. 33 through 35, are within the contemplation of the invention. FIG. 33 shows a sash frame 53A for use in a horizontally sliding window 55A; FIG. 34 shows a sash frame 53B for use in a pivoted window 55B; and FIG. 35 shows a sash frame 53C for use in a double-hung window 55C.

The wall panel sheets 53 thus structured are mounted so as to form a rectangular opening 55 in wall W in cooperation with the sash frames 54 formed in the respective edge portions of these wall panel sheets. Thereafter, in lieu of openable windows, such as 55A, 55B, or 55C, permanent light-admitting panels 56, such as glass or the like, may be installed in the openings 55, as shown in FIGS. 29 and 30.

Figure 32:
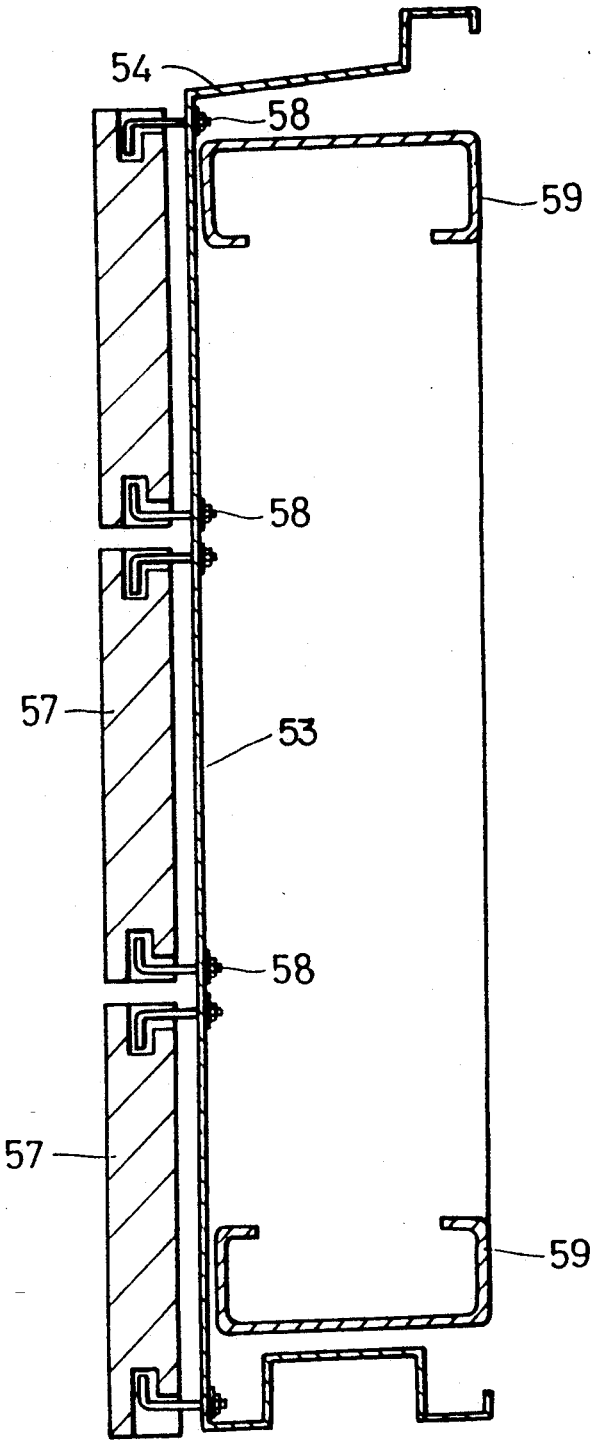
FIG. 32 is an elevational sectional view of a wall panel similar to FIG. 31.
Figures 33, 34, 35:
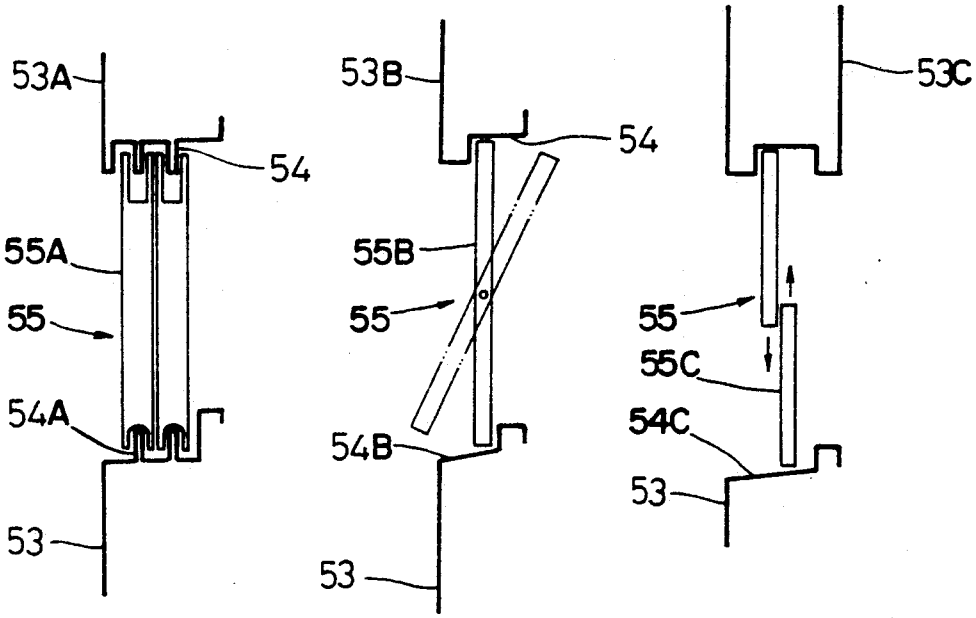
FIGS. 33 through 35 are schematic showings of panel window sashes for sliding, pivoted, and double-hung windows.

If desired, finish materials 57, FIG. 32, such as metal, stone, glass, ceramic tile, or precast concrete members or the like, may be directly attached to the surfaces of the wall panels 53 by mounting bolts 58 or a bonding material to face the wall surface W. If necessary, a reinforcing member 59, such as a steel frame member, concrete member, or the like, may be mounted on the backside of the wall panel 53 for reinforcing purposes. An opening may be provided in a center portion of a wall panel sheet which can then be formed into a window by the above-described steps of forming sash frames on inner peripheral edge portions of the opening. The inner peripheral edge portions of the opening are formed into predetermined sectional shapes. Light panels, such as glass or the like, are then installed in the sash frames formed in the opening.

Figure 10:
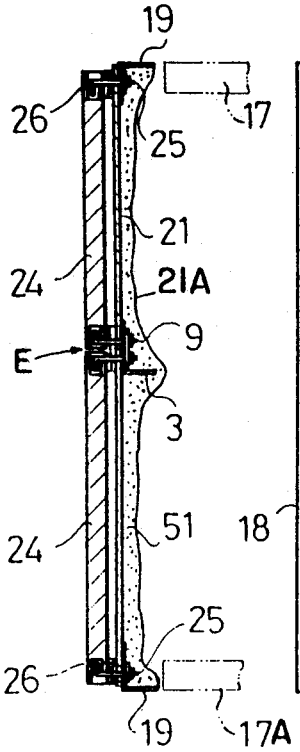
FIG. 10 is a sectional elevational view taken along the line 10—10 of FIG. 9.
Figure 11:
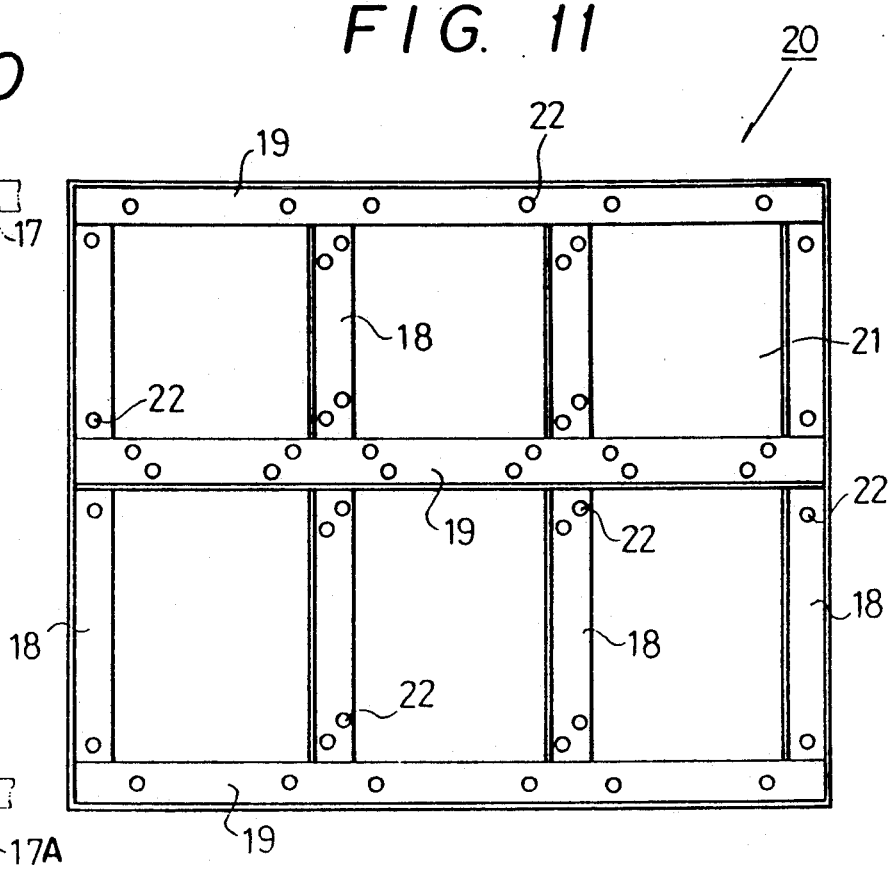
FIG. 11 is an elevational view of the interior side of another panel mounting frame.
Figure 12:
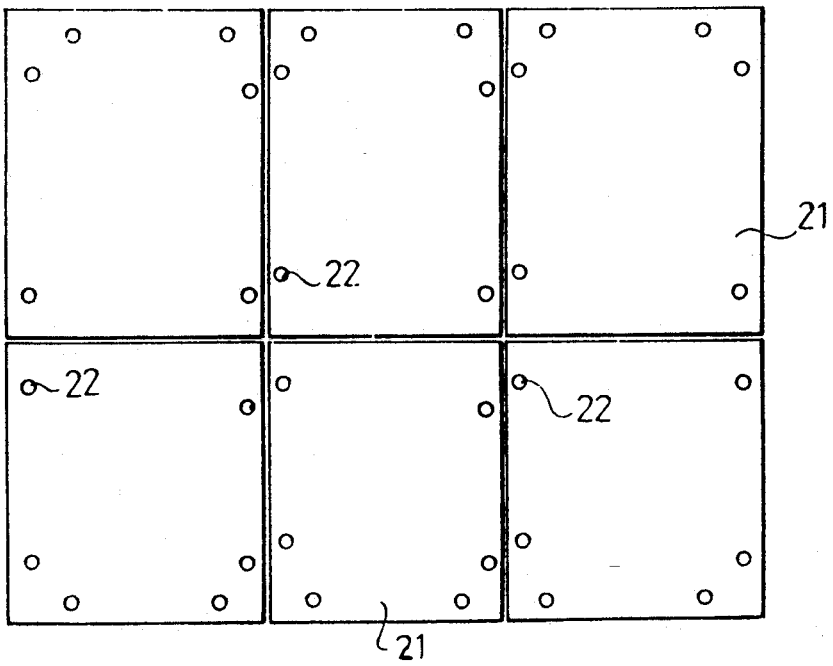
FIG. 12 is a front elevational view showing the panel mounting frame of FIG. 11.
Figure 13:
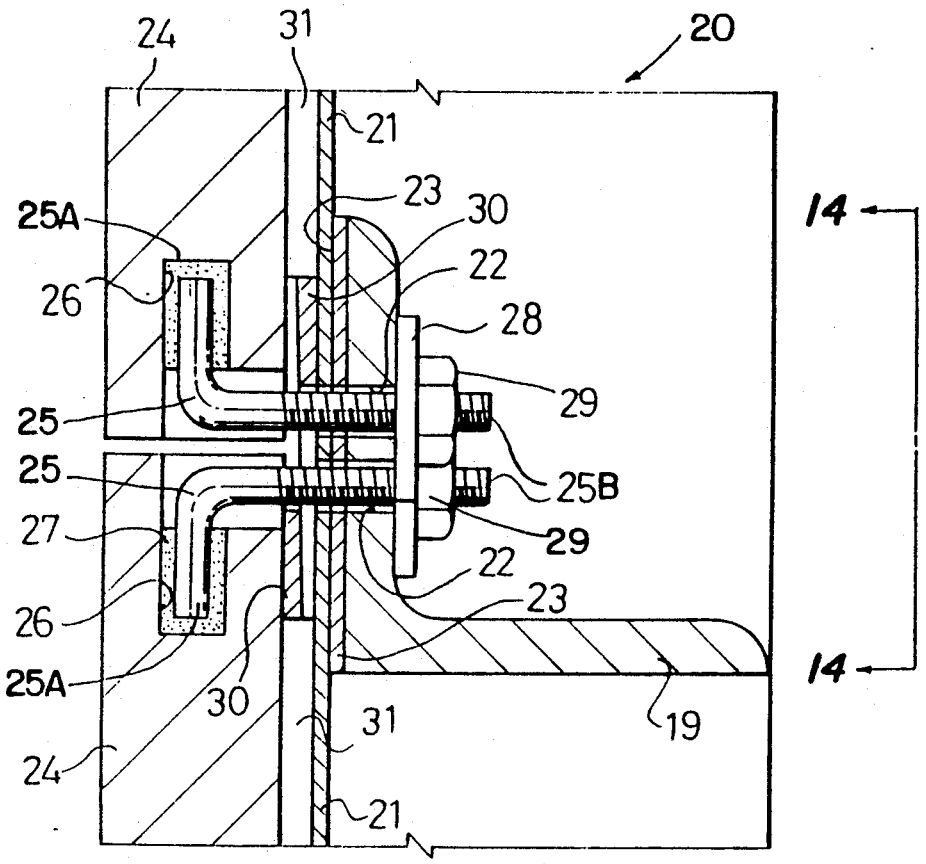
FIG. 13 is an enlarged fragmentary elevational view in section showing part E of FIG. 10.
Figure 14:
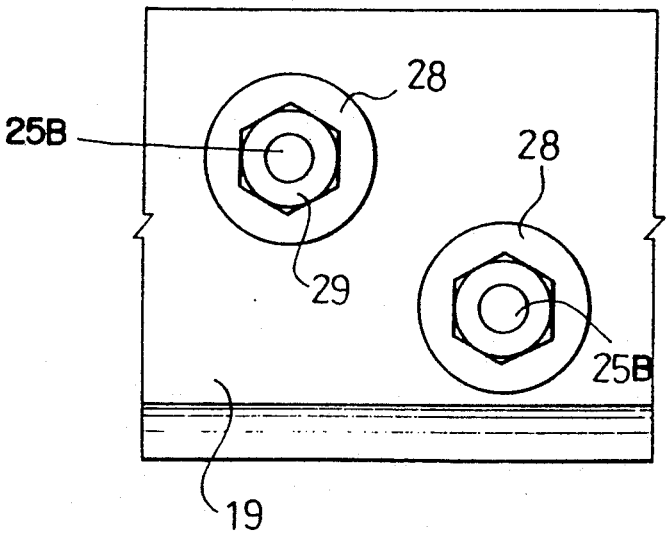
FIG. 14 is a rear elevational view taken along the line 14—14 of FIG. 13.
Figure 15:
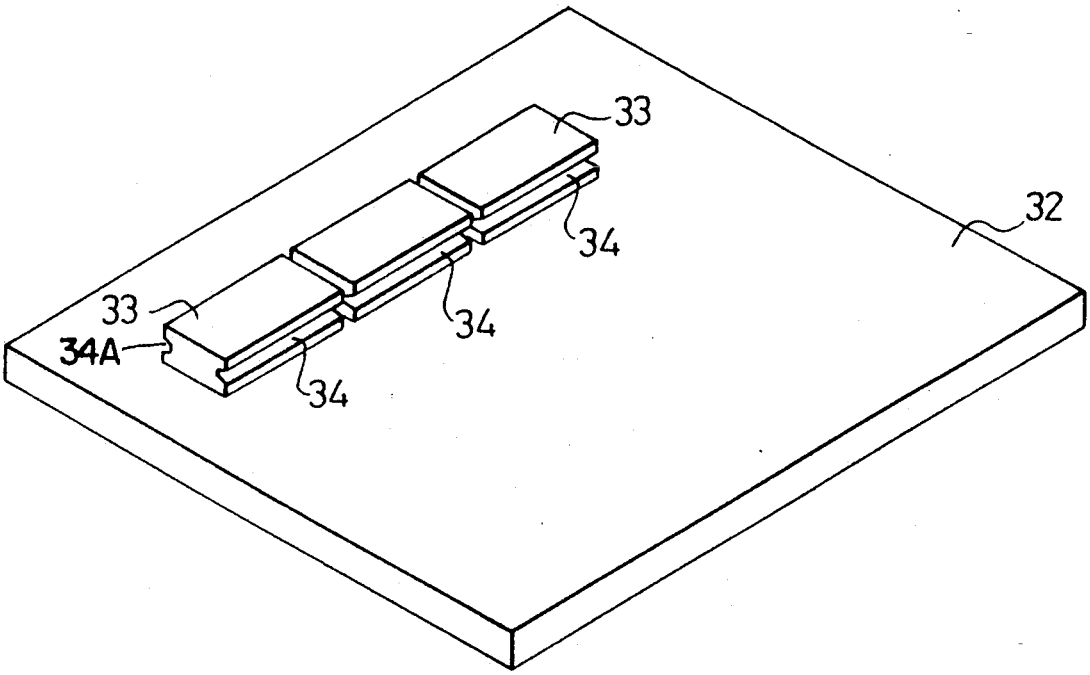
FIGS. 15 through 18 are perspective views in sequence showing a method and apparatus for assembling an external wall panel in accordance with the subject invention.
Figure 19:
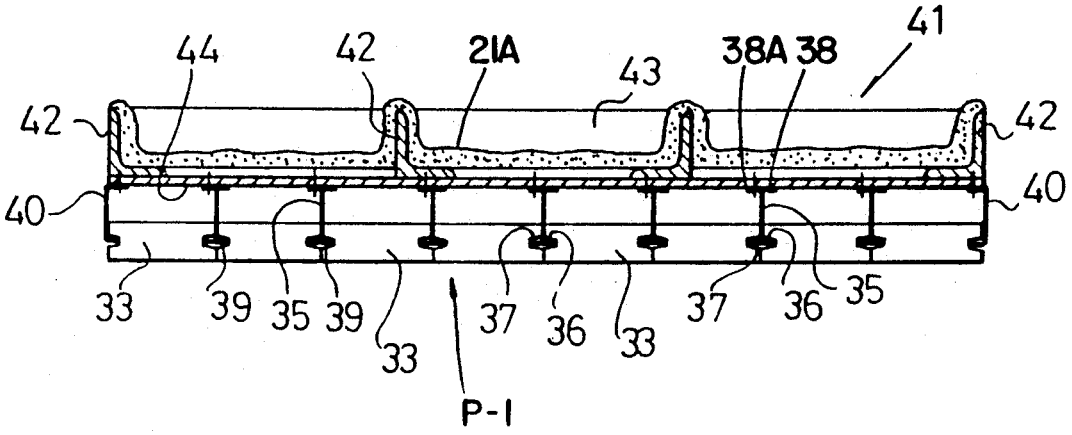
FIG. 19 is a sectional view of an embodiment of the invention being assembled in FIG. 18.
Figure 20:
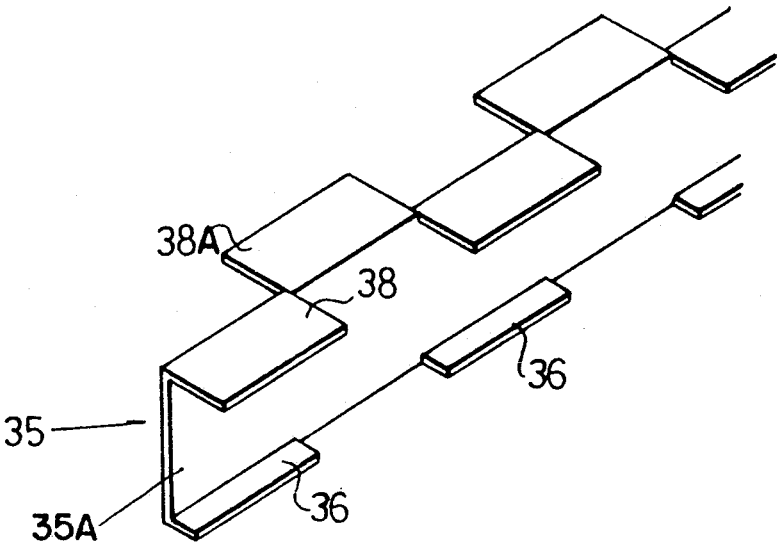
FIG. 20 is a perspective view of the furring strip used to assemble the panel shown in FIG. 18.
Figure 37:
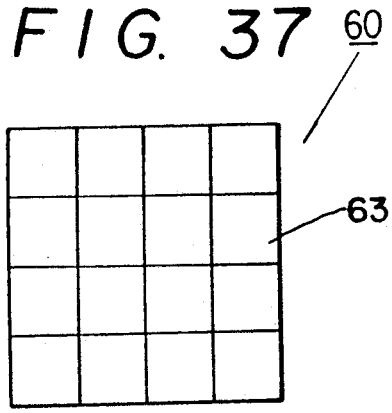
FIGS. 36 and 37 are front elevational views showing further mounting arrangements for external wall panels.
Figure 38:
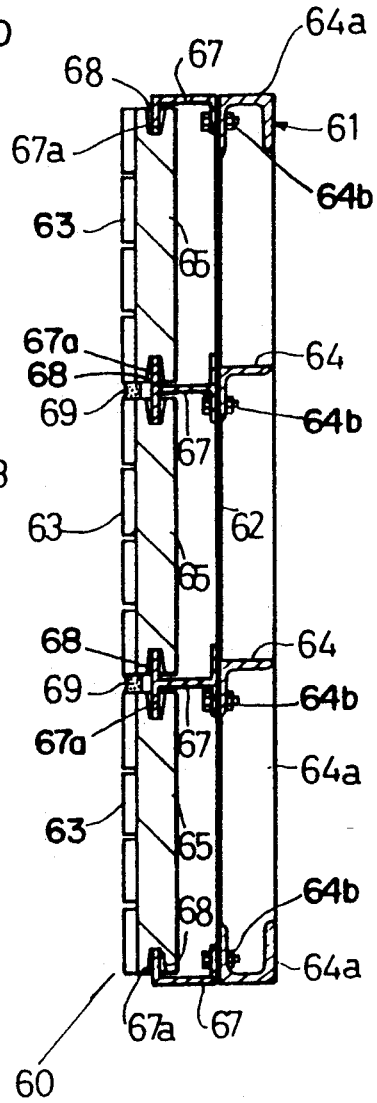
FIGS. 38 and 39 are elevational sectional views of two embodiments of means to mount the panels of FIG. 36.
Figure 36:
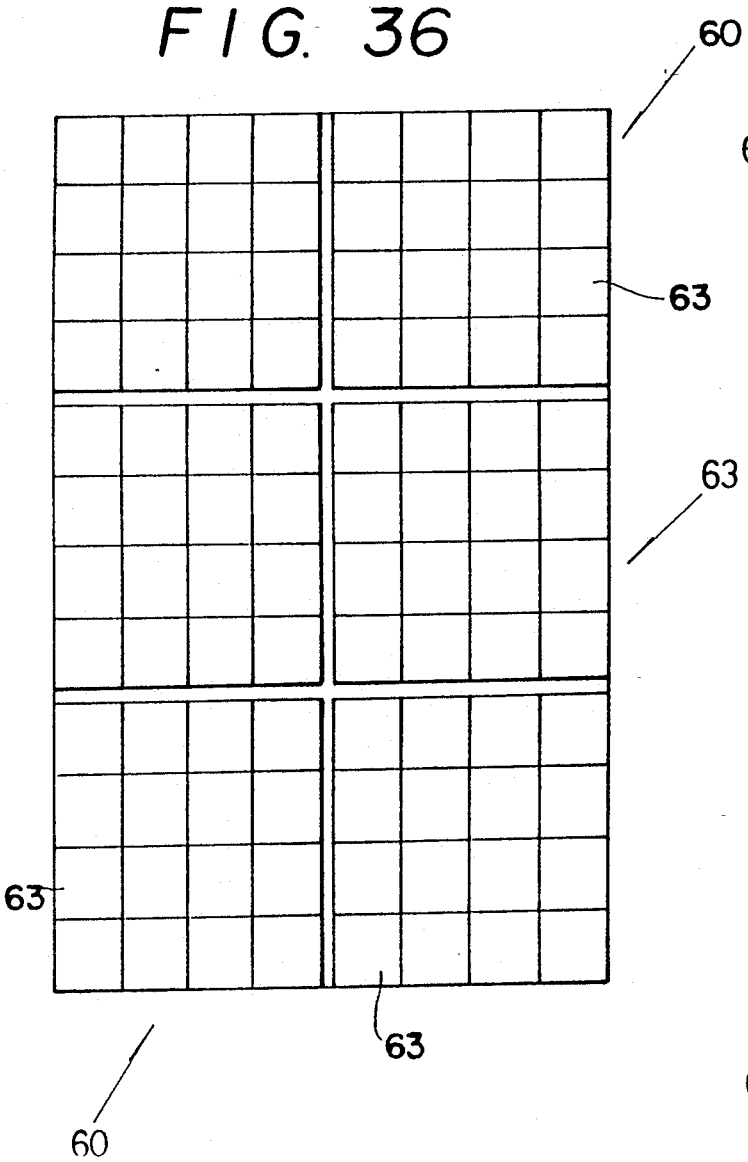
Figure 39:
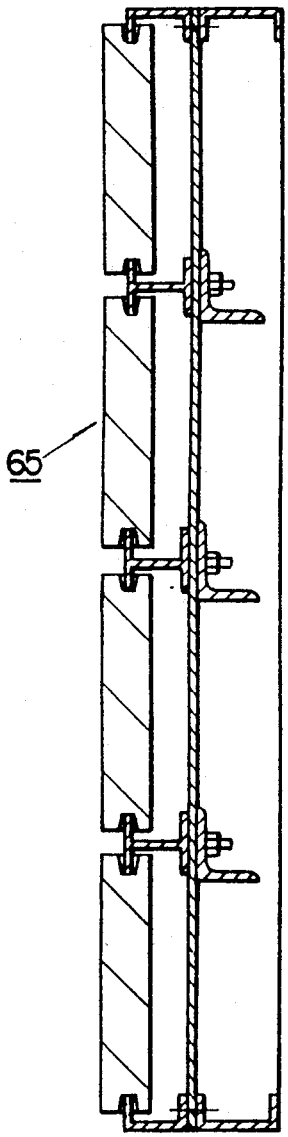

A fifth embodiment of the present invention will now be described with reference to FIGS. 36 through 45. An external wall panel 60, FIG. 37, is so structured that a metal sheet 62 is attached to the surface of a metal frame 61, FIG. 38. A plurality of external plates 63 are attached to the surface of the panel segments 65. The metal frame 61 is comprised of a plurality of lightweight angle steel members 64 and a plurality of lightweight channel steel members **64*a* are formed into a latticework by means of welding or fastening through bolts, similar to the frames described with respect to embodiments 1 through 4. The metal sheet 62 is attached to the surface of the metal frame 61 on the exterior side by means of welding or joining through bolts so as to entirely cover the metal frame surface. Fireproof and waterproof materials are applied to the surfaces of the metal sheets 62, such as shown in FIGS. 10 and 19**.

A plurality of furring strips 67 are mounted on the surface of the metal sheet 62 at uniform intervals in the vertical direction. Each of the furring strips 67 is made of H-shaped sheet material or channel steel material, wherein the furring strips 67 are horizontally attached to the metal sheet 62 by fastening these furring strips to the metal frame 61 and to lattice members 64 and **64*a* with bolts 64*b*. Vertical flange portions 67*a* of the furring strips 67 engage upper and lower grooves 68 in panel segments 65 to secure panel segments 65 to mounting frame 61**.

Figure 40:
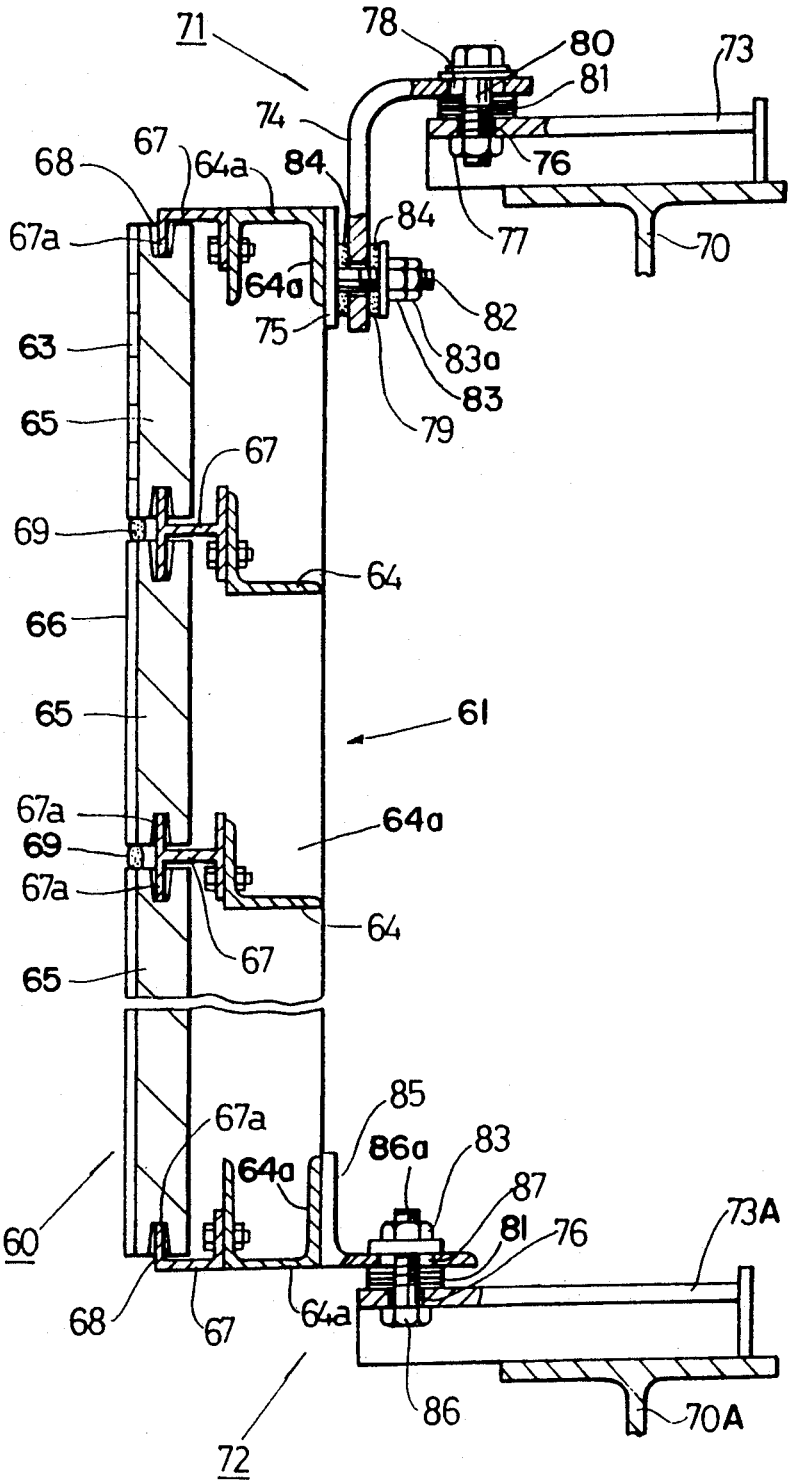
FIG. 40 is an elevational view in fragmentary section of a panel mounted on the frame structural members of a building.

Each external wall panel 60 is comprised of panel segments 65 to which are secured plates 63, such as stone, tile, glass or the like. Panel segments 65 may also be made of lightweight concrete. Since the panel segments 65 fulfill heat-insulating and fireproofing functions as well as the function of holding the tile, stone or glass plates 63, the panel segments are closely held within the strength limits necessary to fulfill these functions in order to lighten the panel segments and to economize on material. Grooves 68, formed in upper and lower edge portions of the panel segments 65, are in continuous alignment with like grooves in laterally adjacent panels. The panel segments 65 thus formed with plates 63 are mounted on furring strips 67 and fixed in position by fitting vertical flange portions 67a into the corresponding upper and lower grooves 68. Interstices are provided between the adjacent panel segments 65 in order to provide for the expansion and contraction of the panel segments due to temperature fluctuations. If necessary, these interstices may be filled with joint material 69. The external wall panels 60 thus structured are mounted between upper and lower beams 70 and 70A of a building, as shown in FIG. 40, with upper and lower fasteners 71, 72, respectively.

The upper fastener 71 consists of an anchor fitting 73, a connection fitting 74, and a receiver fitting 75. Each anchor fitting 73 is welded to the upper surfaces of the upper and lower beams 70 and 70A at uniform intervals along the beams. The mounting distance between the adjacent anchor fittings 73 corresponds to the widths of mounting frames 61. A vertically extending mounting hole 76 is provided in a horizontal portion of the anchor fitting 73 and a mounting nut 77 is attached to the backside of a mounting hole 76 by means of welding. The connection fitting 74 is formed by bending a rectangular plate into an L-like shape and has mounting holes 78, 79 provided in horizontal and vertical portions respectively. The mounting hole 78 provided in the horizontal portion is radially over-size, while the mounting hole 79 in the vertical portion is horizontally elongated.

The connection fitting 74 thus formed is fixedly attached to the anchor fitting 73 by mounting the horizontal portion of the connection fitting 74 on the horizontal portion of the anchor fitting 73 so as to overlap the mounting holes 76, 78, and threading a mounting bolt 80 into the mounting nut 77 through the mounting holes 76 and 78 of the anchor fitting 73 and the connection fitting 74, respectively. Since the mounting hole 78 of the connection fitting 74 is radially over-size and the mounting hole 79 thereof is horizontally elongated, the connection fitting 74 is easily positioned and hence the upper end of the external wall panel 60 may be easily positioned and secured to anchor fitting 73. Further, by interposing a plurality of washers 81 between the horizontal underside portion of the connection fitting 74 and the topside of the anchor fitting 73, the level adjustment of the connection fitting 74 may be easily made. Accordingly, the universal adjustment of the external wall panel 60 may be easily made.

Figure 43:
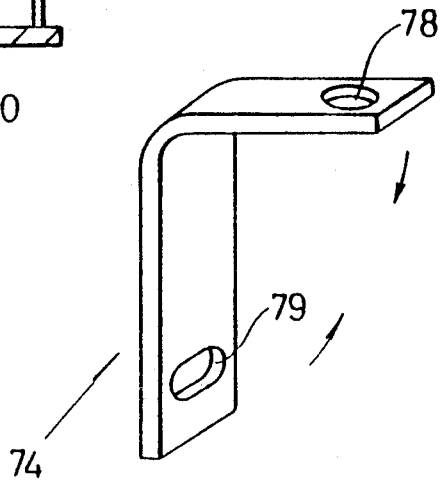
FIG. 43 is a perspective view showing an upper fastener.
Figure 42:
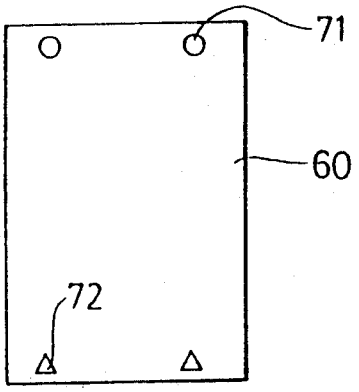
FIG. 42 is a front elevational view showing upper and lower fasteners.
Figure 44:
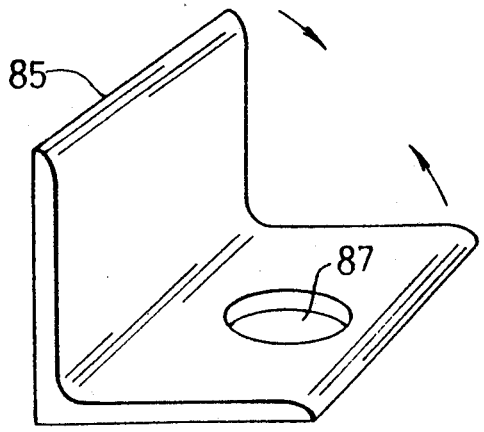
FIG. 44 is a perspective view showing a lower fastener.
Figure 46:
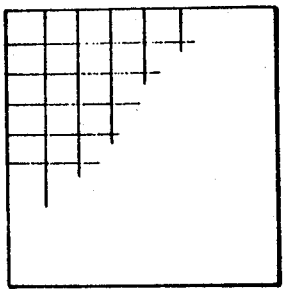
FIG. 46 is a front elevational fragmentary view showing an internal/external composite wall panel.
Figure 45:
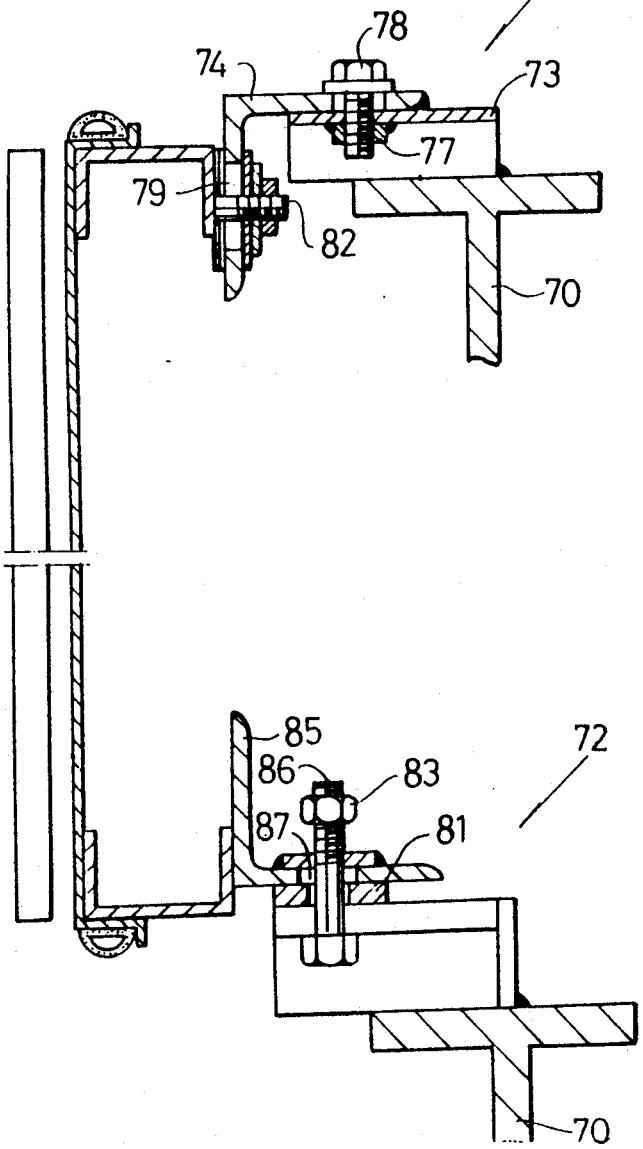
FIG. 45 is an elevational, fragmentary, sectional view showing another embodiment of upper and lower panel fasteners.

Since the connection fitting 74 is formed of elastoplastic metal, the connection fitting 74 is formed, as shown in FIG. 43, to absorb unexpected external forces, such as earthquake tremors. It is therefore possible to avoid damaging the mounting portion of the external wall panel 60 and hence the external wall panel itself.

The receiver fitting 75 is attached to left and right opposite ends of the lightweight channel steel member 64a at the upper end of the external wall panel 60 by means of welding. A mounting bolt 82 is provided on the exposed side of the receiver fitting 75 so as to horizontally project therefrom. The mounting bolt 82 of the receiver fitting 75 extends through the mounting hole 79 of the connection fitting 74 and nut 83 and locknut 83a are screwed onto the threaded portion of the mounting bolt 82 to thereby secure the upper end of the external wall panel 60 in position. An elastic packing 84 made of synthetic rubber or the like is interposed between the vertical portion of the connection fitting 74 and the receiver fitting 75.

The lower fastener 72 consists of an anchor fitting 73A and a connection fitting 85. The head 86 of a mounting bolt 86a is welded to the underside of anchor fitting 73, concentric with mounting hole 76 of the anchor fitting 73A so as to vertically align bolt 86a with its threaded portion projecting upwardly. The connection fittings 85 are attached to left and right opposite ends of the lightweight channel steel member 64a at the lower end of the exterior wall panel 60 by means of welding. The connection fitting 85 is made of angle steel or like material and has a vertically extending, over-size mounting hole 87 bored in a horizontal portion of the connection fitting 85. In the structure as noted above, the lower end of the external wall panel 60 is fixed in position by centering hole 87 over bolt 86 and then lowering the horizontal flange portion of fitting 85 over the mounting bolt 86a until it projects through mounting hole 87 of the connection fitting 85. A nut 83 is then threaded onto the threaded portion of mounting bolt 86. Since the mounting hole 87 of the connection fitting 85 is over-size, the horizontal flange portion of fitting 85 is easily fitted over bolt 86. The right angle relationship between the vertical and horizontal flange portions of the connection fitting 85 enables the fitting 85 to be able to absorb unexpected external forces, such as earthquake tremors.

Figure 41:
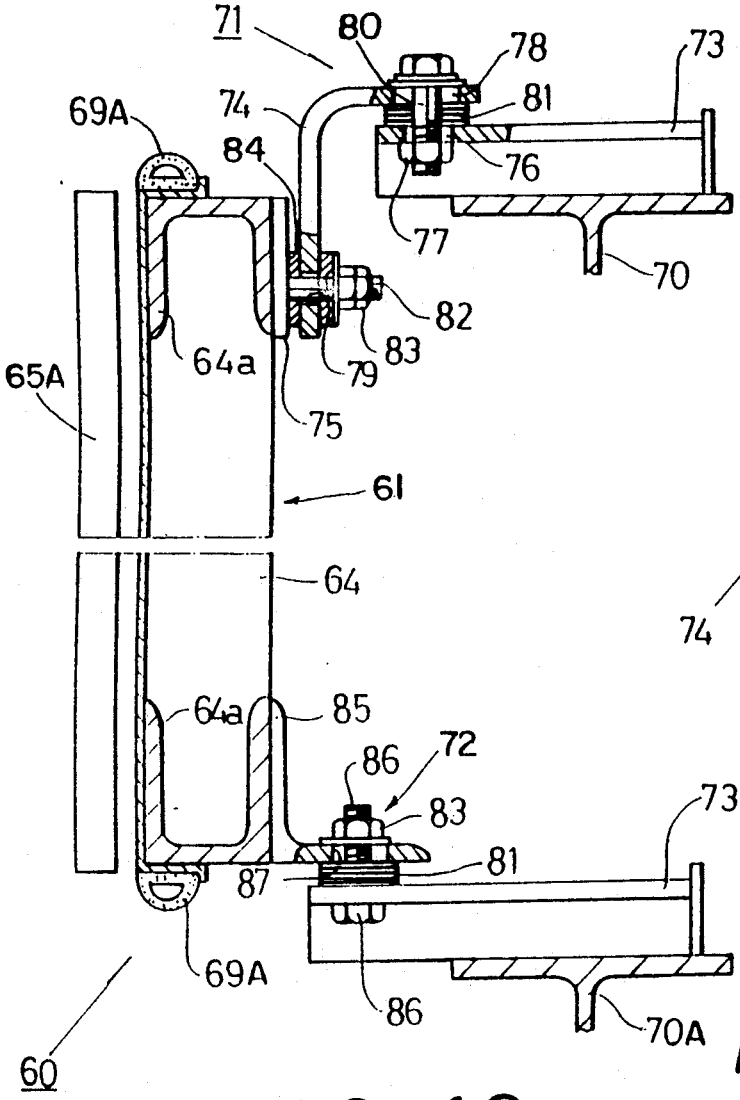
FIG. 41 is an elevational view in fragmentary section of a panel similar to FIG. 40.

FIG. 41 shows another embodiment of panel mounting means wherein the panel segments 65 of FIG. 40 are replaced with a monolithic panel 65A, thereby eliminating the need for joint material 69, as shown in FIG. 40. In lieu thereof, joint material 69A is secured to the exterior surfaces of channels 64a of frames 61 as a moisture seal.

A sixth embodiment of the present invention will now be described with reference to FIGS. 46 through 51. A combination internal/external composite wall panel 88 is so structured that a metal sheet 90 is attached on the exterior side of metal frame 89, a plurality of external panel segments 91 A–D are secured to metal sheet 90 and to frame 89, and an internal panel 92 is mounted on the interior side of the metal frame 89. Internal panel 92 may be plaster board, calcium board, plywood, or the like.

Figure 47:
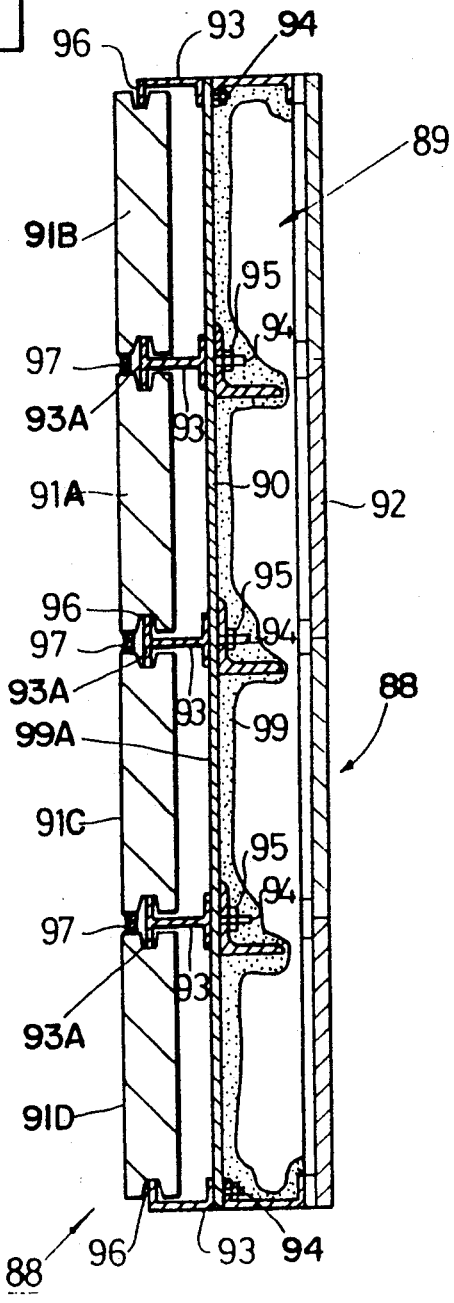
FIG. 47 is an elevational view in section showing the composite wall panel of FIG. 46.
Figure 48:
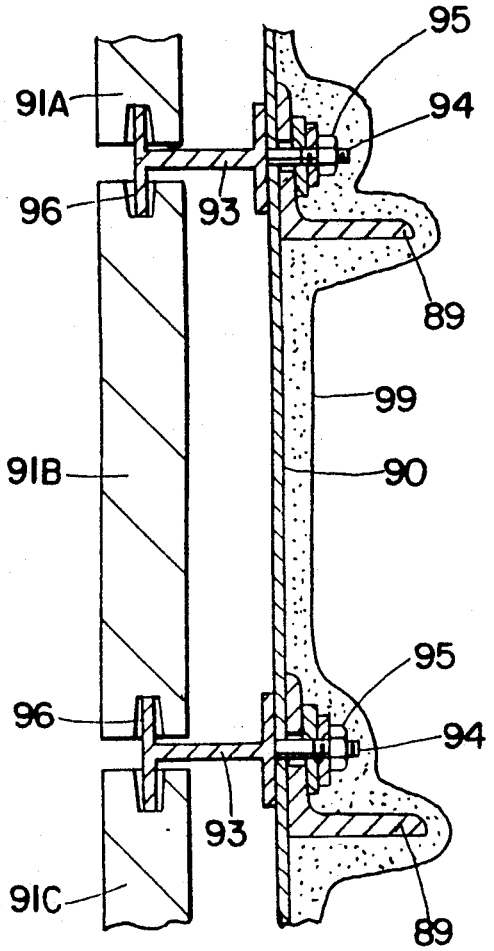
FIG. 48 is an enlarged fragmentary view, partially in section, of a portion of the panel shown in FIG. 47.
Figure 48A:
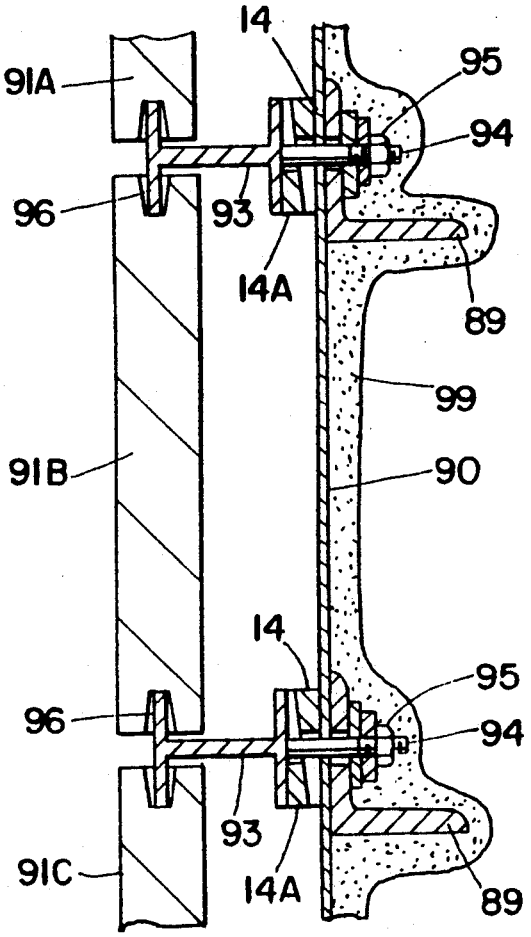
FIG. 48A is an enlarged fragmentary view of a panel similar to the panel of FIG. 48, and including wedge adjustment means.
Figure 49:
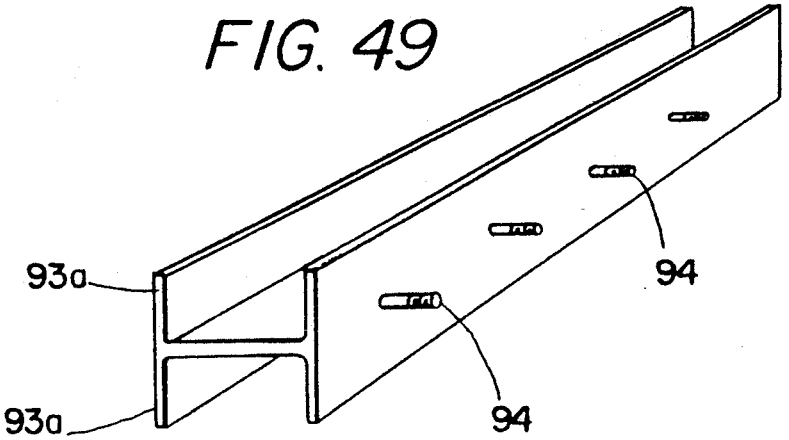
FIG. 49 is a perspective view of the furring strip shown in section in FIG. 48.

A fireproof coating material 99 and a waterproof paint 99A are applied to the surfaces of the metal sheet 90. A plurality of horizontal furring strips 93 are mounted on the surface of the metal sheet 90, as shown in FIG. 47. Each of the furring strips 93 is made of H-shaped steel material or channel steel material. A plurality of horizontally aligned mounting bolts 94 are provided on the interior side of the furring strips at uniform intervals by means of welding so as to project normally therefrom (FIG. 49). The furring strips 93, made of channel steel material, are attached to upper and lower opposite ends of the metal sheet 90 by mounting bolts 94 which pass through corresponding mounting holes of the metal frame 89. Nuts 95 threadedly engage the free ends of mounting bolts 94 to secure furring strips 93 to frame 89 (FIGS. 47 and 48). Further, some interstice is provided between the adjacent external panel segments 91A, 91B, and 91C, for example, in order to absorb the expansion and contraction of each external panel due to changes of temperature. If necessary, the interstices are filled with a joint material 97, FIG. 47.

The combination internal/external composite wall panels 88 thus structured are mounted on predetermined positions of a framework of a building by craning these panels into place and then securing the panels to the building framework with a plurality of fasteners as described hereinabove.

Figure 50:
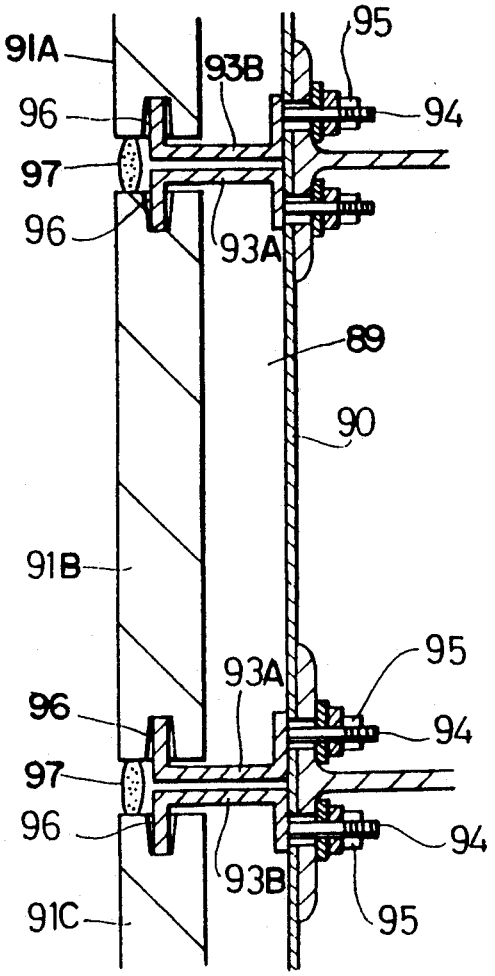
FIG. 50 is a fragmentary view, partially in section, of a portion of a panel showing the use of pairs of U-shaped furring strips.
Figure 51:
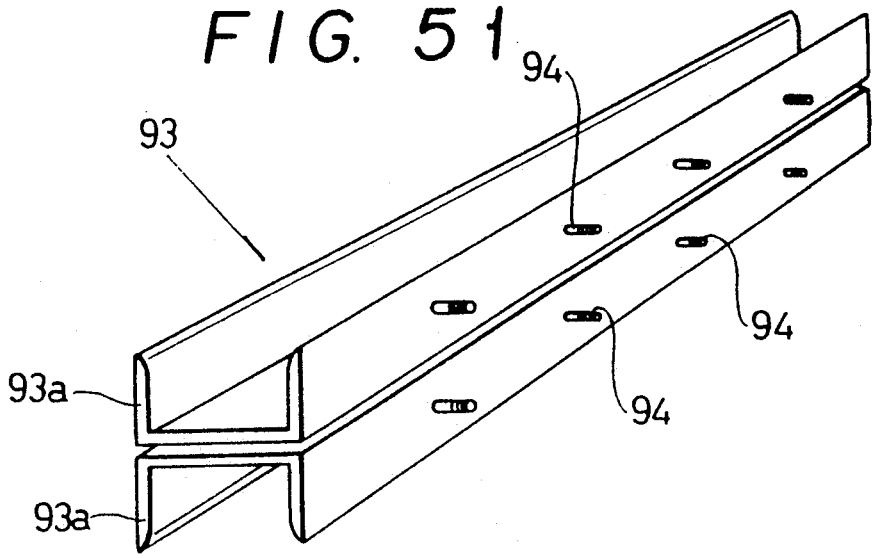
FIG. 51 is a perspective view of the furring strip shown in section in FIG. 50.

The embodiment of the invention shown in FIGS. 50 and 51 provides a unique means for easily and quickly removing an external panel segment 91B without disturbing the adjacent panel segments 91A and 91C. Instead of using one H-shaped channel furring strip 93 as shown in FIG. 47, a pair of back-to-back U-shaped channels 93A–B are employed to eliminate panel interlock such as by flanges 93A of FIGS. 47 and 48, which simultaneously engage and interlock adjacent panel segments 91A, 91B, and 91C. As shown in FIG. 50, for instance, each panel segment 91B is separately secured to frame 89 by upper and lower U-shaped furring strips 93A which engage only the upper and lower grooves 96 of a single panel segment 91B. Thus, to remove a single panel segment 91B, it is necessary to loosen or remove only furring channels 93A, while leaving furring channels 93B and 93C undisturbed and fully secured.

In order to maintain the air pressure in the isopiestic space balanced with the ambient air pressure, a variety of air vents may be provided in the inventive panels, as shown in FIGS. 52 through 58.

Figure 52:
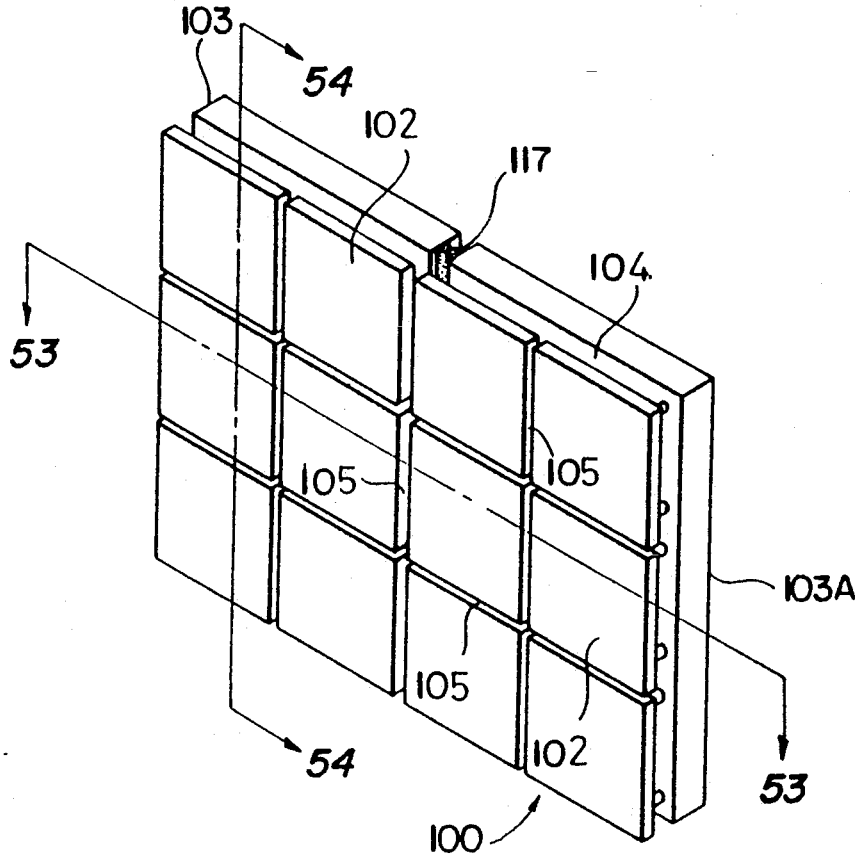
FIG. 52 is a perspective view of another preferred embodiment of the invention.
Figure 53:
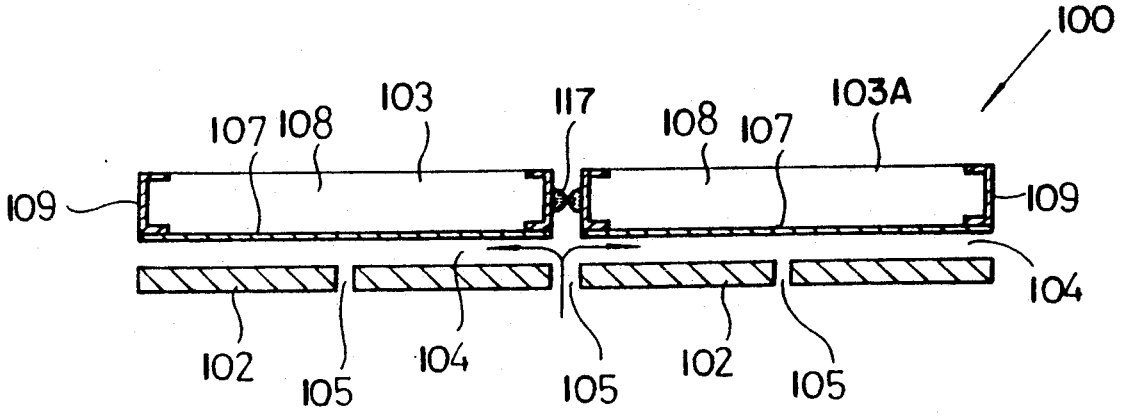
FIG. 53 is a cross-sectional plan view of the embodiment of the invention shown in FIG. 52.
Figure 54:
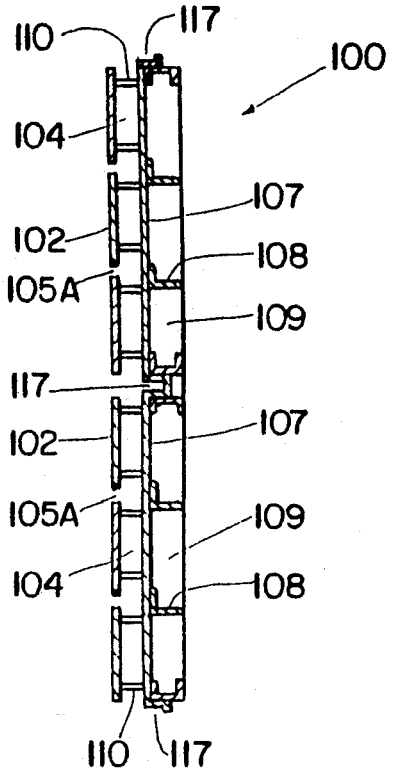
FIG. 54 is a vertical cross-sectional view of panels such as shown in FIG. 52.

As shown in the perspective view of panel 100, FIG. 52 and sectional plan view FIG. 53, a pair of frames 103 and 103A are vertically sealed by gaskets 117. Panel segments 102 are mounted on frames 103 and 103A and spaced apart to provide isopiestic space 104. Space 104 is pressure balanced with vertical ventilation slots 105. FIG. 54 is a vertical sectional view of panel 100 showing that ventilation can also be obtained with horizontal ventilation slots 105A.

Figure 55:
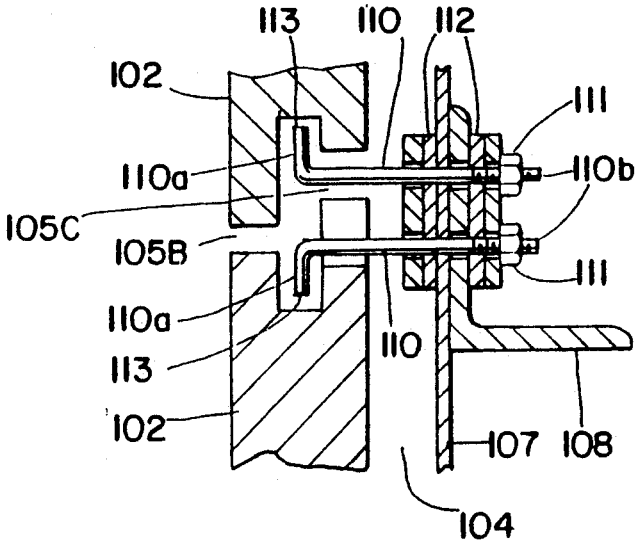
FIG. 55 is an enlarged fragmentary cross-sectional view of a joint portion of a preferred embodiment of the invention.
Figure 55A:
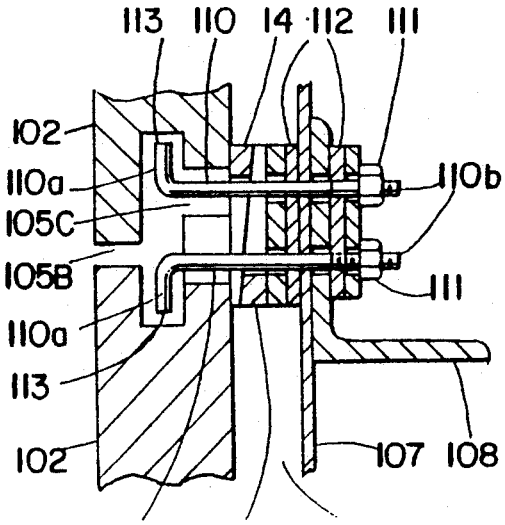
FIG. 55A is an enlarged fragmentary cross-sectional view of the joint portion shown in FIG. 55 and including wedge adjusting means.

In FIGS. 55 and 55A, the slots 105B and 105C are offset to baffle the ingress and egress of air to and from the isopiestic space 104. The embodiment of FIG. 55A also includes adjustment wedges 14 and 14A to render space 104 volumetrically adjustable.

Figure 56:
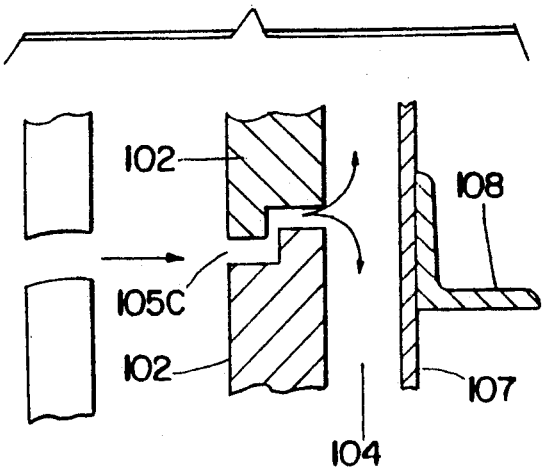
FIG. 56 is an enlarged fragmentary cross-sectional view of another joint portion of the embodiment of the invention shown in FIG. 55.

The embodiment of FIG. 56 discloses an offset slot 105C in addition to adjacent L-shaped slots for mounting bolts 110 of FIG. 55A.

In the embodiment of FIG. 57, the interstice between panel segments 102 is sealed with filler 118 and holes are drilled therein for insertion of ventilation elbows 105D. The change of direction of the air flow in elbows 105D provides the functional equivalent of the offset baffles disclosed in FIGS. 55 and 56.

The embodiment of FIG. 57A discloses the elbow 105D and also adjustment wedges 14 and 14A to render space 104 volumetrically adjustable.

In FIG. 58 is shown a straight ventilation tube 105E inclined downwardly toward the exterior of the panel segment 102. In addition to permitting flow of air to and from the isopiestic space, its angulation prevents the penetration of rain. This benefit is also inherent in elbow 105D of FIG. 57.

It will be understood that the above-described embodiments of the invention are for the purpose of illustration only. Additional embodiments, modifications and improvements can be readily anticipated by those skilled in the art based on a reading and study of the present disclosure. Such additional embodiments, modifications and improvements may be fairly presumed to be within the spirit, scope, and purview of the invention as defined in the subtended claims.

I claim:

1. A wall panel having an exterior side and an interior side for use in sheathing the framework of a building, comprising: a rectangular frame having an exterior side and an interior side; a plurality of rectangular wall panel segments sized to overlay said frame; means to secure said panel segment members to said frame and spaced apart from said frame so as to provide an isopiestic space therebetween; means to adjust the volume of said isopiestic space; means to ventilate said isopiestic space; said means to secure said panel segment members to said frame comprising a plurality of bolts having elongated shafts, bolt head ends, and threaded ends; means to secure said bolt head ends to said panel segments and means to secure said threaded ends to said frame; said means to adjust the volume of said isopiestic space comprising coacting pairs of wedge means and means to secure said pairs of wedge means to said bolts and to sandwich said pairs of wedge means between said panel segments and said frame; said means to secure said pairs of wedge means to said bolts comprising open-ended elongated slots in said pairs of wedge means adapted to straddle said elongated shafts of said bolts, whereby the shifting of said pairs of wedge means on said elongated shafts of said bolts, one with respect to the other, shifts said panel segment members spacewise relative to said frame.

2. The wall panel of claim 1, wherein said means to ventilate said isopiestic space comprises provision of means to permit free flow of air between said isopiestic space and the exterior side of said wall panel wherein selected wall panel segments are spaced apart to permit free flow of air between said isopiestic space and said exterior side of said wall panel.

3. The wall panel of claim 1, including an interior wall member secured to said interior side of said wall panel.

4. A wall panel having an exterior side and an interior side for use in sheathing the framework of a building, comprising: a rectangular frame having an exterior side and an interior side; a plurality of rectangular wall panel segments sized to overlay said frame; means to secure said panel segment members to said frame and spaced apart from said frame so as to provide an isopiestic space therebetween; means to adjust the volume of said isopiestic space; means to ventilate said isopiestic space; means for securing said wall panel to said framework of said building adapted to provide universal adjustment of said wall panel with respect to said framework; said means for securing said wall panel to said framework comprising: L-shaped brackets each having a vertical leg and a horizontal leg; bolt means to secure said vertical leg to said frame; an oversized bolt hole in said vertical leg adapted to provide universal movement in a vertical plane between said bolt means and said bolt hole; threaded stud means to secure said horizontal leg to said framework; an over-sized stud hole in said horizontal leg adapted to provide universal movement in a horizontal plane between said threaded stud means; wedge means to shift said vertical leg horizontally, and washer means to shift said horizontal leg vertically.

5. A wall panel having an exterior side and an interior side for use in sheathing the framework of a building, comprising: a rectangular frame having an exterior side and an interior side; a plurality of rectangular wall panel segments sized to overlay said frame; means to secure said panel segment members to said frame and spaced apart from said frame so as to provide an isopiestic space therebetween; means to adjust the volume of said isopiestic space; means to ventilate said isopiestic space; and a metal sheet configured to cover said rectangular frame and to selectively extend beyond one edge of said frame to form one member of a window sash.

6. A wall panel having an exterior side and an interior side for use in sheathing the framework of a building, comprising: a rectangular frame having an exterior side and an interior side; a plurality of rectangular wall panel segments sized to overlay said frame; means to secure said panel segment members to said frame and spaced apart from said frame so as to provide an isopiestic space therebetween; means to adjust the volume of said isopiestic space; and means to ventilate said isopiestic space; said wall panel being in combination with three other like wall panels arrayed on the framework of a building to define a rectangular window opening, comprising:

a first rectangular frame positioned adjacent the top edge of said rectangular window opening, having a bottom portion; a first rectangular sheet configured to cover said frame and to extend beyond said frame bottom portion to form a top window sash member;

a second rectangular frame having a top portion; a second rectangular sheet configured to cover said frame and to extend beyond said frame top portion to form a bottom window sash member;

a third rectangular frame having a left side portion; a third rectangular sheet configured to cover said frame and to extend beyond said frame left side portion to form a right side window sash member; and a fourth rectangular frame having a right side portion; a fourth rectangular sheet configured to cover said frame and to extend beyond said frame right side portion to form a left side window sash member.

7. The wall panels of claim 6, wherein said side wall panels define a window sash adapted to receive a fixed window pane.

8. The wall panels of claim 6, wherein said side wall panels define a window sash adapted to receive a plurality of sliding window panes therein.

9. The wall panels of claim 6, wherein said wall panels define a window sash adapted to receive a pivoted window pane therein.

10. The wall panels of claim 6, wherein said wall panels define a window sash adapted to receive a pair of double hung window panes therein.

* * * * *